US007580654B2

(12) United States Patent
Okubo

(10) Patent No.: US 7,580,654 B2
(45) Date of Patent: Aug. 25, 2009

(54) IMAGE FORMING APPARATUS FEATURING DISCHARGE PREVENTION IN A TRANSFER SEPARATION AREA

(75) Inventor: Kazuhiro Okubo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 11/511,349

(22) Filed: Aug. 29, 2006

(65) Prior Publication Data

US 2007/0048011 A1 Mar. 1, 2007

(30) Foreign Application Priority Data

Aug. 30, 2005 (JP) ..... 2005-250254
Aug. 11, 2006 (JP) ..... 2006-220718

(51) Int. Cl.
*G03G 21/00* (2006.01)

(52) U.S. Cl. ..... 399/128

(58) Field of Classification Search ..... 399/128
See application file for complete search history.

(56) References Cited

U.S. PATENT DOCUMENTS 6,807,384 B2 10/2004 Okubo et al. ..... 399/50
6,928,253 B2 8/2005 Ojima et al. ..... 399/129
6,963,707 B2 11/2005 Kinoshita et al. ..... 399/129
7,058,338 B2 6/2006 Ojima et al. ..... 399/149
7,149,437 B2 12/2006 Okubo ..... 399/27
2005/0025520 A1* 2/2005 Murakami et al. ..... 399/111
2005/0271416 A1 12/2005 Kinoshita et al. ..... 399/129

FOREIGN PATENT DOCUMENTS

JP 1-232371 9/1989
JP 2002023456 A * 1/2002
JP 2002174965 A * 6/2002

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes a movable bearing member; a charging device for electrically charging the image bearing member at a charging position; a transferring device for contacting the image bearing member at the transfer position and for transferring a toner image from the image bearing member onto a transfer material; a transfer device separating mechanism for effecting a separating operation by which the transferring device and the image bearing member contacted to each other are separated from each other; and a discharging device for electrostatically discharging the image bearing member; and a controller for controlling the discharging device to electrically discharge regions of the image bearing member so as to avoid an electrical discharge when the transfer device and contacting device and separating member are separated.

7 Claims, 9 Drawing Sheets

IMAGE FORMING APPARATUS FEATURING DISCHARGE PREVENTION IN A TRANSFER SEPARATION AREA

FIELD OF THE INVENTION AND RELATED ART

The present invention relates to an image forming apparatus such as a copying machine, a printing machine, a facsimile machine, etc. More specifically, it relates to an image forming apparatus, which has a mechanism for separating a transferring apparatus from an image bearing member.

An electrophotographic image forming apparatus, such as a copying machine, a printer, a facsimile machine, etc., has been widely used. In an electrophotographic image forming apparatus, an electrophotographic photosensitive member (photosensitive member); as an image bearing member, is uniformly charged, and then, an electrostatic image (latent image) is formed on the peripheral surface of the photosensitive member, by exposing the charged peripheral surface of the photosensitive drum, in accordance with image formation information. Then, the electrostatic image on the photosensitive drum is developed with toner. Then, the developed image is directly, or indirectly (by way of an intermediary transferring member), transferred onto recording medium, such as recording paper.

Further, an electrophotographic color image forming apparatus, which is capable of forming multicolor images, such as full-color images, has also come to be widely used. As one of the examples of an electrophotographic color image forming apparatus, there is an electrophotographic color image forming apparatus of the tandem type, in which multiple image formation stations for forming multiple images, different in color, one for one, are aligned in the direction parallel with the direction in which recording medium is conveyed.

Further, the electrophotographic color image forming apparatuses of the tandem type can be divided into two groups, which are the direct and indirect transfer types. In the direct transfer type, the toner images formed in different colors on the photosensitive members of the multiple image formation stations, one for one, are sequentially transferred in layers onto the transfer medium, such as recording paper, which is being conveyed by a transfer medium bearing member. In the indirect transfer type, that is, the transfer type which employs an intermediary transferring member, the toner images formed in different colors on the photosensitive members of the multiple image formation stations, one for one, are, first, sequentially transferred in layers onto the intermediary transferring member, and then, transferred all at once from the intermediary transferring member onto the recording medium, such as recording paper, which is being conveyed, separately from the intermediary transferring member, by a transfer medium bearing member.

Next, the image forming operations of the image forming apparatus of the tandem type will be described. When the image forming apparatus is operated in the full-color image formation mode, first, the photosensitive members in all the image formation stations are driven. Then, the following image formation process is sequentially carried out in all the image formation stations, starting from the most upstream image formation station in terms of the moving direction of the transfer medium bearing member or the intermediary transfer member. That is, first, the peripheral surface of the photosensitive drum is discharged by operating the pre-exposing apparatus. Then, the discharged peripheral surface of the photosensitive drum is uniformly charged by applying charge bias to the charging apparatus. Then, the developer bearing member with which the developing device is provided is rotationally driven, and a preset developing bias is applied to the developer bearing member. Thereafter, the developer bearing member is placed in contact with the photosensitive drum while keeping the developer bearing member rotated. The area of the peripheral surface of the photosensitive drum, which the developer bearing member contacts, has been charged in advance by the charging apparatus. Therefore, there is a preset amount of difference in potential between the charged area of the peripheral surface of the photosensitive drum and the developer bearing member. Incidentally, the pre-exposing apparatus is set to begin emitting exposure light no later than the time when the area of the peripheral surface of the photosensitive drum, which is to be used for the formation of an electrostatic image, passes by the pre-exposing apparatus.

The above-described preparatory operation is sequentially carried out in synchronization with the timing with which the actual image formation operation is started, in all the image formation stations, starting from the most upstream station. Then, the photosensitive member is exposed by the exposing apparatus, in accordance with the image formation information. As a result, an electrostatic image is formed on the peripheral surface of the photosensitive drum. Then, the toner on the developer bearing member is transferred onto the peripheral surface of the photosensitive drum, in a manner to mirror (reversely) the electrostatic image, developing thereby the electrostatic image into a visible image, or a toner image, that is, an image formed of toner. The toner image, as an object to be transferred, formed on the photosensitive drum is transferred onto a transfer medium on the transfer medium bearing member or the intermediary transfer member.

As soon as the above-described image formation process is sequentially completed in all the image formation stations, that is, as soon as it is completed in the most downstream image formation station, the charge bias is turned off, and the transfer bias is turned off. Then, the develop bearing member is separated from the photosensitive drum.

Thereafter, the entirety of the peripheral surface of the photosensitive drum is rendered uniform in potential by the pre-exposing apparatus, and then, the pre-exposing apparatus is turned off. Then, the rotation of the photosensitive member is stopped, which ends the image formation process. It is described in the background technology section of Japanese Laid-open Patent Application 1-232371 (which hereafter will be referred to as Patent Document 1), for example, that during the post-rotation of the photosensitive member, which begins immediately after the area of the peripheral surface of the photosensitive member, which was used for the formation of an electrostatic image, passes by the charging apparatus, the charging apparatus is turned off, and the entirety of the peripheral surface of the photosensitive member is discharged by exposing the photosensitive member at least for a length of time equivalent to the circumference of the photosensitive member after the charging apparatus is turned off. It is also described in Patent Document 1 that during the post-rotation of the photosensitive member, which begins after the area of the peripheral surface of the photosensitive member, which was used for the formation of an electrostatic image, passes by the charging apparatus, the electric charge of the photosensitive member is removed by AC voltage.

Exposure of a photosensitive drum to light detrimentally affects the photosensitive drum; it reduces a photosensitive drum in sensitivity and chargeability. Thus, extended exposure of a photosensitive drum to light sometimes results in the formation of flawed images, the flaws of which are attributable to the deterioration of the photosensitive drum in terms of sensitivity and chargeability. Therefore, in order to reduce the amount of the photo-induced deterioration of photosensitive member by reducing the length of the pre-exposure time, it is possible to turn off the pre-exposing apparatus as soon as the area of the peripheral surface of the photosensitive drum, which is to be used for the formation of an electrostatic image, passes by the pre-exposing apparatus.

Among the electrophotographic color image forming apparatuses of the tandem type, such as those described above, there are those provided with a mechanism designed so that when monochromatic images, such as black monochromatic images, are formed, it separates the transfer medium bearing member or intermediary transfer member from the photosensitive drum, in each of the image formation stations which are not used for the on-going monochromatic image forming operation; for example, when black monochromatic images are formed, it separates the transfer medium bearing member or intermediary transfer member from the photosensitive drums which are in the yellow, magenta, and cyan image formation stations. Further, some electrophotographic image forming apparatuses of the tandem type, which use a contact developing method which places a developer bearing member in contact with a photosensitive drum to develop a latent image on the photosensitive drum, are designed so that in each of the image formation stations which are not used for the on-going image forming operation, the developer bearing member is separated from the photosensitive drum, and the developer bearing member and photosensitive member are not driven. With the employment of these designs, it is possible to prevent the photosensitive member or the like, in the image formation stations which are not in use, from wearing and/or deteriorating.

However, it has become evident that the image forming apparatuses having the mechanism for separating a transfer medium bearing member or intermediary transfer member, from a photosensitive member suffers from the following problems which occur when the transfer medium bearing member or the intermediary transfer member is separated from the photosensitive member.

Generally, in order to prevent the vibrations which occur during the operation in which a developer bearing member is separated from a photosensitive member, the operation for separating the developer bearing member from the photosensitive member is carried out after all the toner images on all the photosensitive drums, one for one, are transferred onto the transfer medium. While the developer bearing member is in contact with the photosensitive member, a preset amount of difference in potential needs to be provided between the developer bearing member and the photosensitive member to prevent the formation of images suffering from "fog" which is attributable to the adhesion of toner to the points of the peripheral surface of the photosensitive drum, to which toner is not to adhere. Therefore a control is executed so that until the developer bearing member separates from the photosensitive member, the charge bias is continuously applied to the charging apparatus to charge the photosensitive drum, and then, as soon as the developer bearing member separates from the photosensitive member, the charge bias for charging the peripheral surface of the photosensitive member is turned off.

Thus, when the operation for separating the transfer medium bearing member or the intermediary transfer member from the photosensitive member is started immediately after the completion of the transfer operation, the transfer medium bearing member or the intermediary transfer member is separated from the charged area of the peripheral surface of the photosensitive member.

During this operation of separating the transfer medium bearing member or the intermediary transfer member from the photosensitive member, electric discharge sometimes occurs between the transfer medium bearing member or the intermediary transfer member, because the transfer medium bearing member or the intermediary transfer member is separated from the charged area of the peripheral surface of the photosensitive drum. The occurrence of this electric discharge sometimes renders the peripheral surface of the photosensitive member extremely nonuniform in potential.

If the photosensitive member which was rendered nonuniform in potential across its peripheral surface is stopped and left as it is, this nonuniformity in potential persists, as a memory, on the peripheral surface of the photosensitive member, causing the image forming apparatus to output flawed images during the following image forming operation.

Thus, the primary object of the present invention is to provide an image forming apparatus which has a mechanism for separating an image bearing member from a transferring apparatus, and which does not form flawed images, the flaws of which are attributable to the electric discharge which occurs when the transferring apparatus separates from the image bearing member.

SUMMARY OF THE INVENTION

According to the present invention, it is possible to prevent an image forming apparatus having a mechanism for separating a transferring apparatus from an image bearing member, from forming flawed images, the flaws of which are attributable to the electric discharge which occurs when the transferring apparatus is separated from the image bearing member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings.

Embodiment 1

[General Structure]

Figure 1:
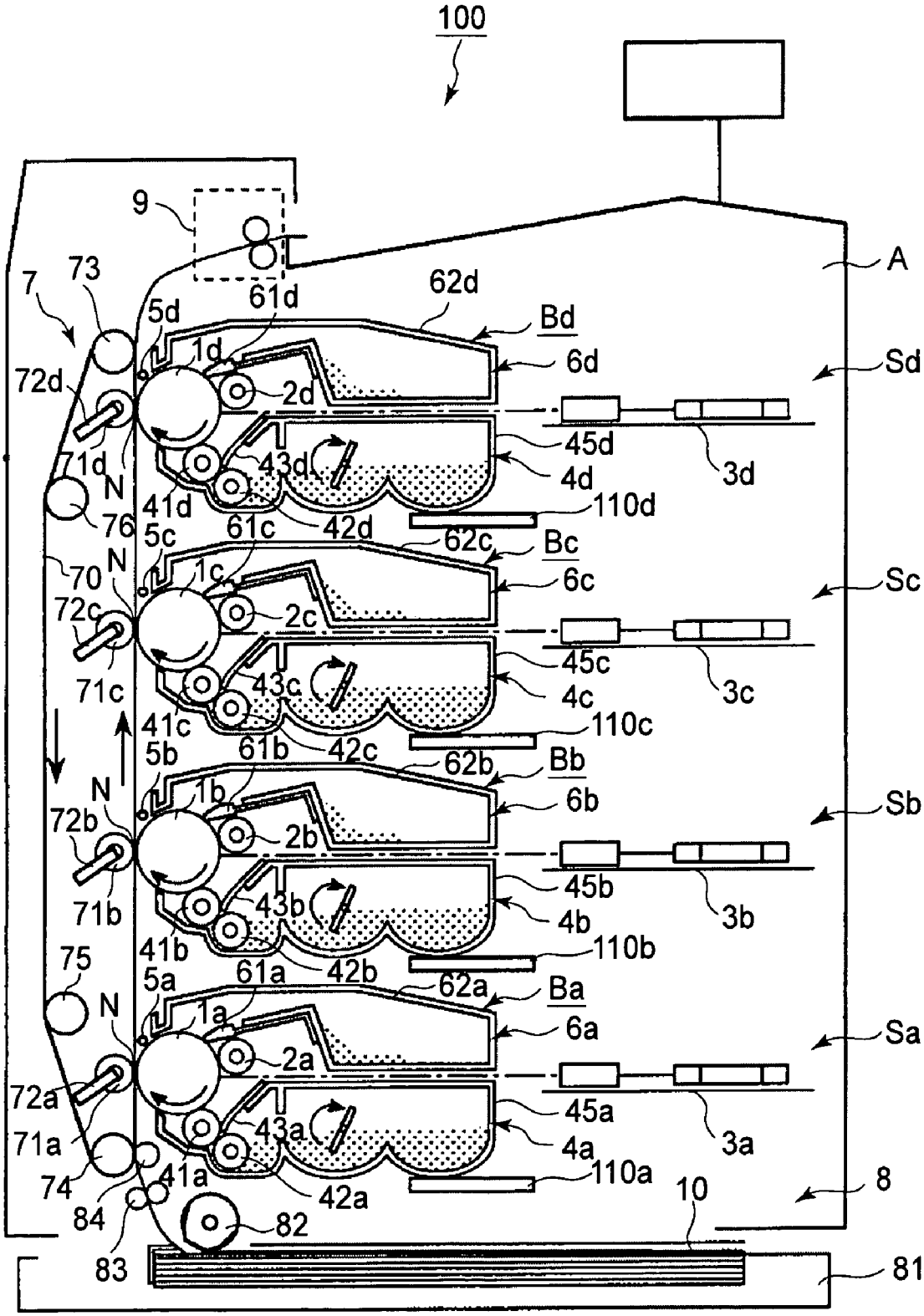
FIG. 1 is a schematic sectional view of the image forming apparatus according to a first preferred embodiment of the present invention.

First, the general structure of the image forming apparatus in this (first) embodiment of the present invention will be described. FIG. 1 is a schematic sectional view of the image forming apparatus 100 in this embodiment. The image forming apparatus 100 is a full-color laser beam printer capable of forming full-color images on transfer medium (recording paper, OHP sheet, fabric, etc.), with the use of an electrophotographic method, in response to image information signals, which are transmitted to the main assembly A of the image forming apparatus from a host computer, an original reading apparatus, a digital camera, or the like, which is connected to the image forming apparatus main assembly A so that information can be exchanged between the main assembly A and the apparatuses connected to the main assembly A. In this embodiment, the image forming apparatus 100 is of the tandem type, and employs the direct transfer system.

The image forming apparatus 100 in this embodiment has first, second, third, and fourth image formation stations Sa, Sb, Sc, and Sd, which are aligned in the direction parallel with the direction in which transfer medium is conveyed. The first-fourth image formation stations Sa-Sd are for forming yellow, magenta, cyan, and black monochromatic images, respectively. Incidentally, in this embodiment, all the image formation stations are practically the same in basic structure and operation, except for the color of the toners they use. Therefore, in the following descriptions of the preferred embodiments of the present invention, the referential suffixes a, b, c, and d added to show the relationship between each component and the corresponding color component may be eliminated when describing the features common among all the image formation stations.

Each image formation station S has a cylindrical electrophotographic photosensitive member, as an image bearing member, that is, a photosensitive drum 1. In the adjacencies of the peripheral surface of the photosensitive drum 1, a charge roller 2 as a charging means for uniformly charging the peripheral surface of the photosensitive drum 1, a laser beam scanner 3, as an optical exposing means, and a developing device 4 as a developing apparatus for developing an electrostatic image formed on the photosensitive drum 1, with the use of toner, are disposed. The image forming apparatus 100 is also provided with a transfer unit 7, as a transferring apparatus, which is disposed in a manner to oppose the photosensitive drums 1*a*-1*d* of the image formation stations Sa-Sd, respectively. Also disposed in the adjacencies of the peripheral surface of the photosensitive drum are a pre-exposing apparatus 5 (pre-exposing means), as an electric charge removing apparatus for exposing the area of the peripheral surface of the photosensitive drum, which has just gone through the transfer process, and a cleaner 6, as a cleaning means, for recovering the toner remaining on the peripheral surface of the photosensitive drum after the transfer process.

The transfer unit 7 is provided with a transfer medium bearing member (endless conveyor belt 70) and transfer rollers 71*a*-71*d*. The conveyor belt 70 bears the transfer medium 10 and conveys it along each of the image formation stations Sa-Sd. The conveyor belt 70 is stretched around a driver roller 74 as a belt driving means, a follower roller 74, and a pair of tension rollers 75 and 76. The conveyor belt 70 circularly moves (rotates) in the direction (counterclockwise) indicated by an arrow mark in the drawing. As the material for the conveyor belt 70, resin film formed of PVdF, ETFE, polyimide, PET, polycarbonate, or the like, which is 50-200 μm in thickness, $10^9$-$10^{16}$ ohm.cm in volume resistivity, or film made up of a roughly 0.5-2 mm thick substrate layer formed of rubber, such as EPDM, and a surface layer formed on the substrate layer, of urethane rubber in which fluorinated resin such as PTFE is dispersed, may be used, although the choices of the material for the conveyor belt 70 are not limited to the above-mentioned ones. In this embodiment, an endless belt formed of PVdF is employed as the conveyor belt 70.

On the inward side of the loop which the conveyor belt 70 forms (which hereafter may be referred to transfer belt loop), transfer rollers 71*a*-71*d* are located so that they oppose the photosensitive drums 1*a*-1*d* of the image formation stations Sa-Sd, respectively. The transfer rollers 71*a*-71*d* are enabled to press the conveyor belt 70 against the photosensitive drums 1*a*-1*d*, respectively, with the application of a preset amount of pressure. As the conveyor belt 70 is pressed against the photosensitive drum 1 by the transfer roller 71 located on the inward side of the transfer belt loop, a transfer nip is formed at the transfer point N between the photosensitive drum 1 and conveyor belt 70; the interface between the photosensitive drum 1 and conveyor belt 70 constitutes the transfer nip.

Figure 2:
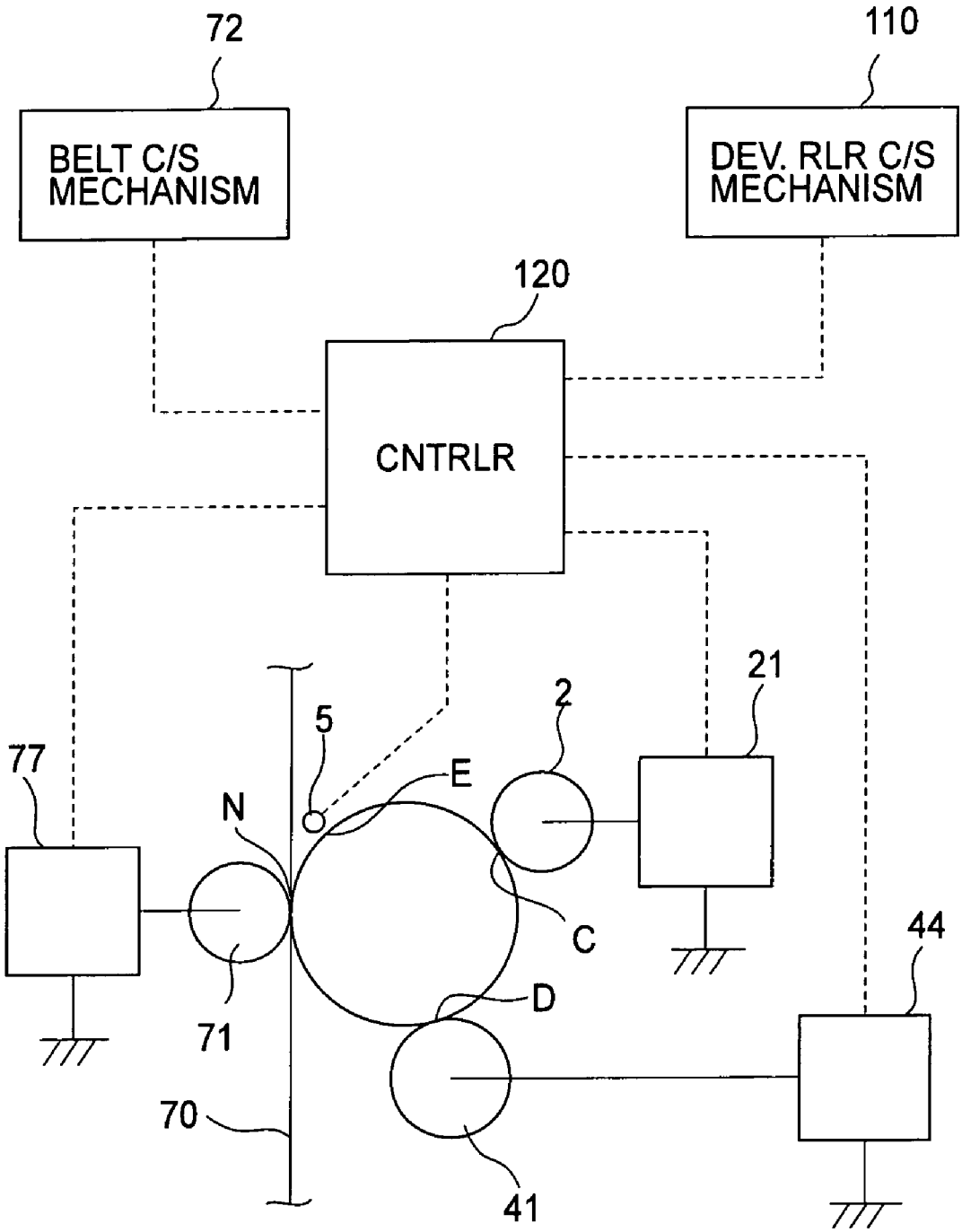
FIG. 2 is a block diagram showing the control of the image forming apparatus according to the first preferred embodiment.

Referring to FIG. 2, the photosensitive drum 1 is made up of an aluminum cylinder as the substrate of the photosensitive drum 1, and a layer of photosensitive substance (which in this embodiment is organic photoconductive substance) formed on the peripheral surface of the substrate. The photosensitive drum 1 is rotationally driven in the direction (clockwise direction) indicated by an arrow mark in the drawing, at a preset process speed (peripheral surface velocity). In this embodiment, the photosensitive drum 1 is charged to the negative polarity.

The charge roller 2 contacts the photosensitive drum 1 at a charging point C, and is rotated by the rotation of the photosensitive drum 1. To the charge roller 2, a charge bias power source 21, as a charge bias outputting means, is connected. To the charge roller 2, a preset charge bias voltage is applied, with a preset timing, from the charge bias power source 21. As the charge bias is applied to the charge roller 2, the charge roller 2 charges the photosensitive drum 1 to the negative polarity, at the charging pint C.

The developing device 4 is provided with a container 45 (developing means housing), in which developer, which in this embodiment is nonmagnetic single-component developer), that is, toner, is stored. In this embodiment, the normal polarity to which the toner is charged is negative. The developing means housing 45 is provided with an opening which faces the photosensitive drum 1. A development roller 41, as a developer bearing member, is rotatably disposed in the developing means housing 45 so that it is partially exposed through this opening. The developing device 4 has a supply roller 42, as a developer supplying means, for supplying the development roller 41 with toner. Further, the developing device 4 has a development blade 43, as a developer regulating member, which regulates the amount by which toner is borne on the peripheral surface of the development roller 41. The development roller 41 is placed in contact with the photosensitive drum 1. Therefore, it is formed of an elastic substance. Further, the development roller 41 is rotationally driven in such direction that the movement of its peripheral surface in the area in which it opposes the photosensitive drum 1 is the same as the movement of the peripheral surface of the photosensitive drum 1 in the same area. On the other hand, the supply roller 42 is rotationally driven in such direction that the movement of its peripheral surface in the area in which it opposes the photosensitive drum 1 is opposite to the movement of the peripheral surface of the photosensitive drum 1 in the same area.

The toner is supplied to the peripheral surface of the development roller 41 by the supply roller 42. Then, the toner on the peripheral surface of the development roller 41 is regulated in the thickness of the layer it forms, and then, is supplied to the developing station G where the toner layer opposes the peripheral surface of the photosensitive drum 1. The toner is negatively charged by the friction which occurs when it is supplied to the development roller 41 by the supply roller 42, the friction which occurs when it moves between the development roller 41 and development blade 43, and the like. To the development roller 41, a development bias power source 44, as a development bias outputting means, is connected. To the development roller 41, a preset development bias voltage is applied from the development bias power source 44, with a preset timing, providing thereby the development sleeve 41 with a preset potential. As a result, the toner is transferred from the development roller 41 onto the photosensitive drum 1. In this embodiment, the toner adheres to the points of the peripheral surface of the photosensitive drum 1, which have been attenuated in potential due to the exposure.

The transfer roller 71 is placed in contact with the inward surface (with reference to transfer belt loop) of the conveyor belt 70 so that the conveyor belt 70 is pressed upon the photosensitive drum 1. The transfer roller 71 is rotated by the movement of the conveyor belt 70. To the transfer roller 71, a transfer bias power source 77, as a transfer bias outputting means, is connected. To the transfer roller 71, a preset transfer bias, the polarity (which in this embodiment is positive) of which is opposite to the normal polarity to which the toner is charged, is applied from the transfer bias power source 77, with a preset timing. As a result, the toner image on the photosensitive drum 1 is electrostatically transferred onto the transfer medium 10 borne on the conveyor belt 70, at the transfer point N.

The pre-expo sing apparatus 5 is positioned so that it exposes the photosensitive drum 1, at a discharging point E, which is downstream of the transfer point N and upstream of the charging point C, in terms of the moving direction (rotational direction) of the peripheral surface of the photosensitive drum 1. The pre-exposing apparatus 5 is designed so that it can project light onto the entirety of the area of the peripheral surface of the photosensitive drum 1, across which an electrostatic image is to be formed (an area which is going to be image formation area), at least in the direction parallel with the rotational axis of the photosensitive drum 1. Therefore, the pre-exposing apparatus 5 can discharge the charged peripheral surface of the photosensitive drum 1, at the discharging point E. The choices of a pre-exposing apparatus are not limited to the pre-exposing apparatus 5 described above. For example, a pre-exposing apparatus of the chip-array type, such as a pre-exposing apparatus having multiple light sources, such as LEDs, aligned in a preset pattern, may be employed in place of the pre-exposing apparatus 5. Also can be employed in place of the pre-exposing apparatus 5 is a pre-exposing apparatus, which is provided with a single or pair of light sources, such as LEDs, located at one or both of the lengthwise ends thereof, in terms of the axial direction of the photosensitive drum 1, and a light guide for directing the light from the light source toward the peripheral surface of the photosensitive drum 1. Further, a pre-exposing apparatus which is provided with a single or pair of light sources, such as LEDs, located at one or both of the lengthwise ends thereof, in terms of the axial direction of the photosensitive drum 1, and is designed so that the peripheral surface of the photosensitive drum 1 is directly illuminated by the light from the light sources, may be employed.

The cleaner 6 has a cleaning blade 61, as a cleaning member, formed of an elastic substance. The cleaning blade 61 is disposed in contact with the photosensitive drum 1, and scraps away the toner on the photosensitive drum 1 to recover the toner into a waste toner bin 62 (photosensitive drum housing).

In this embodiment, the photosensitive drum 1, and the processing means, more specifically, the charge roller 2, developing device 4, and cleaner 6, are integrally disposed in a cartridge, making up a process cartridge B, which is removably mountable in the image forming apparatus main assembly A. In the developing means housing 45 (developing means container) of the process cartridges Ba-Bd, four toners, which are different in color, that is, yellow, magenta, cyan, and black toners, are stored, respectively. These process cartridges B, which store the toners, different in color, one for one, are aligned in the moving direction of the surface of the conveyor belt 70, that is, the direction in which the transfer medium 10 is conveyed by the conveyor belt 70.

In the process cartridge B, the photosensitive drum 1, charge roller 2, and cleaning blade 61 are supported by the photosensitive member housing 62, whereas the development roller 41, supply roller 42, and development blade 43 are supported by the developing means housing 45, making up the developing device 4. The developing means housing 45 is connected to the photosensitive member housing 62 so that it is allowed to pivotally move relative to the photosensitive member housing 62. Pivotally moving the developing means housing 45 makes it possible to switch the positional relationship between the development roller 41 and photosensitive drum 1, between the state in which the development roller 41 is in contact with the photosensitive drum 1 and the state in which the development roller 41 is not in contact with the photosensitive drum 1.

More specifically, the image forming apparatus 100 is provided with development roller separation mechanisms 110, each of which makes it possible to place the development roller 41 in contact with the photosensitive drum 1 or separate the development roller 41 from the photosensitive drum 1, in each of the image formation stations Sa-Sd, independently from the development rollers 41 in the other image formation stations. When an image is formed in a given image formation station S, the development roller 41 and photosensitive drum 1 of this image formation station S are placed in contact with each other by the development roller separation mechanism 110 of this image formation station S, whereas when no image is formed in this image formation station S, the development roller 41 and photosensitive drum 1 of this image formation station S are kept separated by the development roller separation mechanism 110 of this image formation station S. In this embodiment, the development roller separation mechanism 110 causes the developing means housing 45 to rotate in the counterclockwise direction of FIG. 1, by pushing the developing means housing 45 in the upward direction of FIG. 1. Further, the development roller separation mechanism 110 can be moved away from the developing means housing 45 to allow the developing means housing 45 to rotate in the clockwise direction of FIG. 1, allowing thereby the development roller 41 to come into contact with the photosensitive drum 1.

The image forming apparatus 100 is provided with a transfer belt separation mechanism 72, which switches the positional relationship between the conveyor belt 70 and photosensitive drum 1, between the state in which the conveyor belt 70 is in contact with the photosensitive drum 1 and the state in which the conveyor belt 70 is not in contact with the photosensitive drum 1. The transfer belt separation mechanism 72 is designed so that the photosensitive drum 1 in each of the image formation stations Sa-Sd can be separated from, or placed in contact with, the conveyor belt 70, independently from the photosensitive drums 1 in the other image formation stations. In this embodiment, the transfer belt separation mechanism 72 moves the transfer roller 71 between the position into which the transfer roller 71 is moved to be kept pressed against the photosensitive drum 1 and the position into which the transfer roller 71 is moved to remove the contact pressure between the transfer roller 71 and photosensitive drum 1. In other words, the transfer belt separation mechanism 72 places the conveyor belt 70 in contact with the photosensitive drum 1 or separates the conveyor belt 70 from the photosensitive drum 1.

Figure 3:
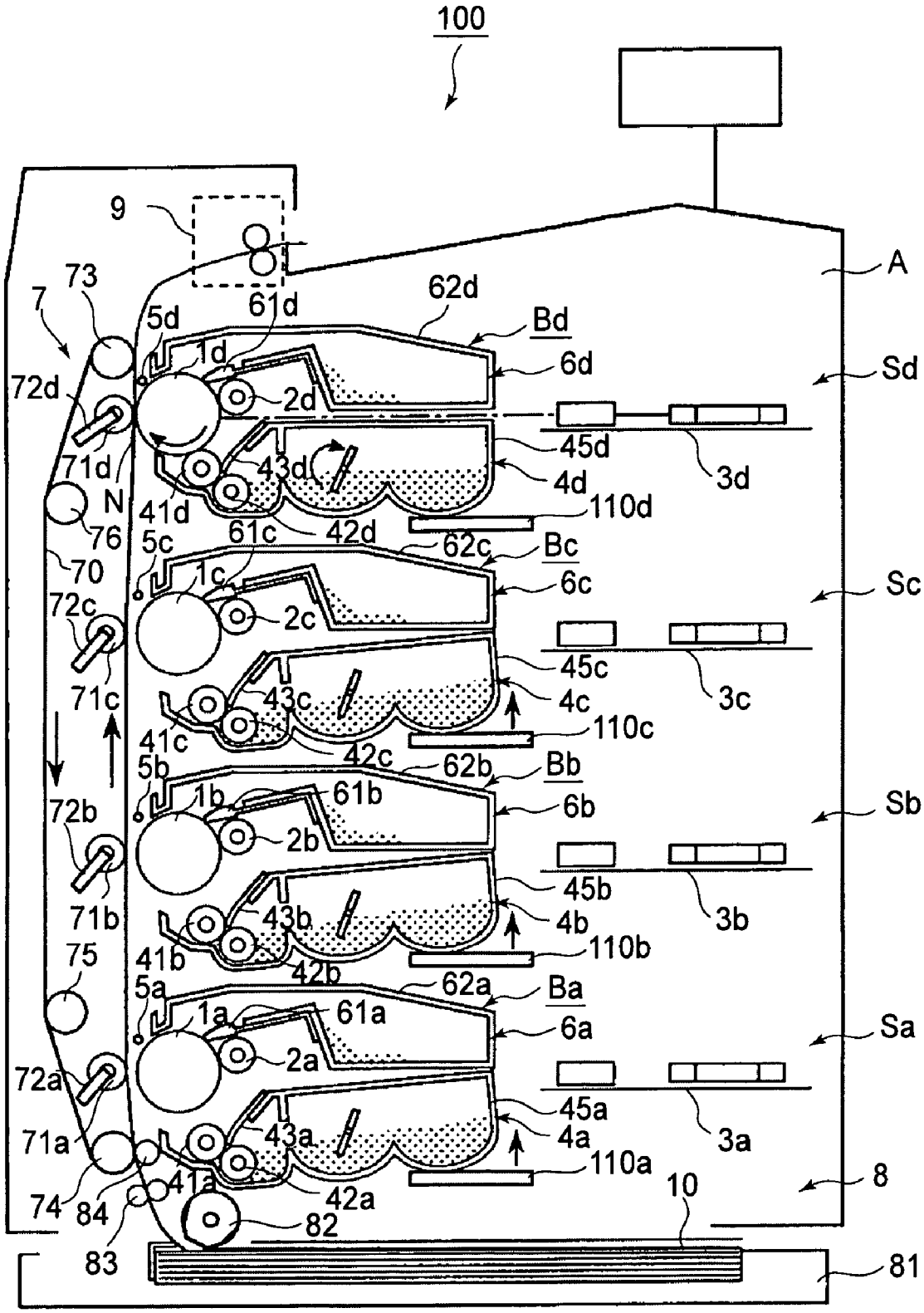
FIG. 3 is a schematic sectional view of the image forming apparatus in FIG. 1, which is in the monochromatic mode.

The image forming apparatus 100 in this embodiment is provided with the full-color mode (first image formation mode), as one of its image formation modes, for forming full-color images, and the monochromatic mode (second image formation mode), as the other image formation mode, for forming black monochromatic images. In the full-color mode, the development rollers 41 in all of the first-fourth image formation stations Sa-Sd are placed in contact with the corresponding photosensitive drums 1, and the conveyor belt 70 contacts all the photosensitive drums 1, as shown in FIG. 1, allowing all the toner images formed in all of the first-fourth image formation stations Sa-Sd to be transferred onto the transfer medium 10 on the conveyor belt 70. On the other hand, when the image forming apparatus 100 is in the monochromatic mode, only the development roller 41 (41*d*) in the fourth image formation station Sd is placed in contact with the corresponding photosensitive drum 1 (1*d*), and the conveyor belt 70 contacts only the photosensitive drum 1 (1*d*) in the fourth image formation station Sd, as shown in FIG. 3, allowing only the toner image formed in the fourth image formation station Sd to be transferred onto the transfer medium 10 on the conveyor belt 70. In other words, the conveyor belt 70 is kept separated from the photosensitive drums 1*a*, 1*b*, and 1*c* in the image formation stations Sa-Sc, respectively.

Referring to FIG. 2, the overall operation of the image forming apparatus 100 is controlled by a controller 120 as a controlling means. The controller 120 controls the operational sequence of the image forming apparatus 100 according to the programs and various data stored in the controller itself, or a storage means connected to the controller 120. In particular, in this embodiment, the controller sends control signals to the charge bias power source 21, development bias power source 44, transfer bias power source 77, and pre-exposing apparatus 5, to drive these components with preset timings, which will be described later in detail. The controller 120 also sends control signals to the transfer belt separation mechanism 72 and development roller separation mechanism 110, to drive the mechanisms with preset timings, which will be described later in detail.

[Image Formation Operation]

(Full-Color Mode)

Figure 4:
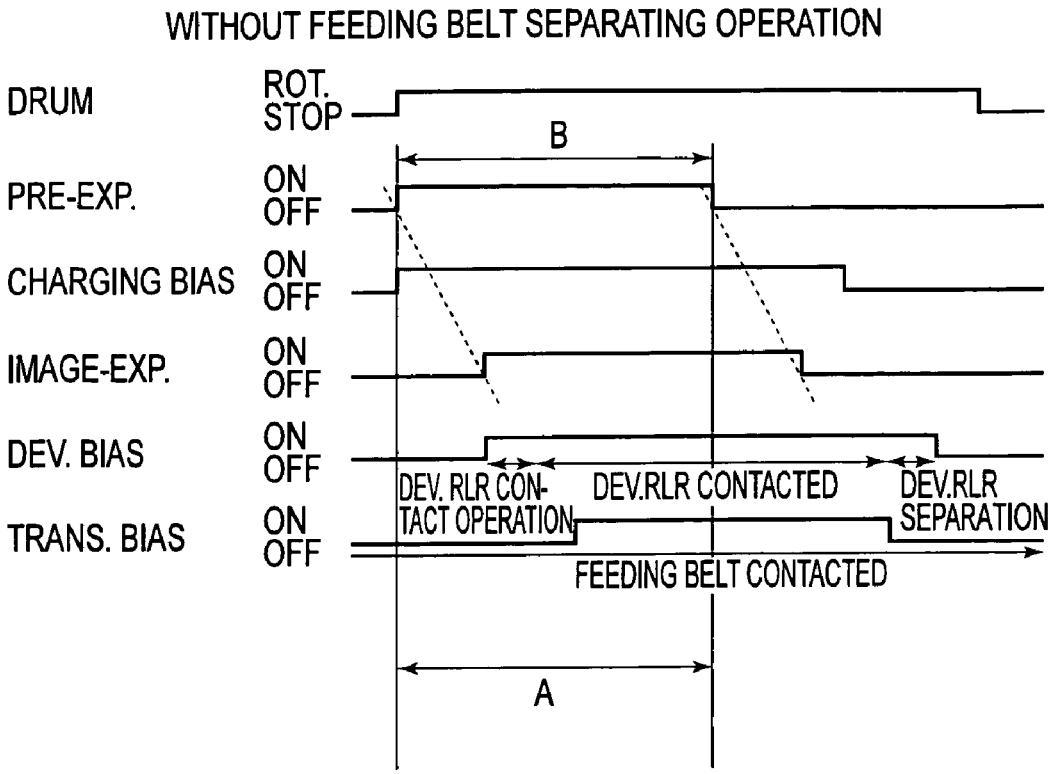
FIG. 4 is a diagram showing the durations and timings of the operations carried out by the various components of an image forming apparatus when the apparatus is in a mode in which the operation for separating the transferring apparatus from the photosensitive drum is not carried out.

First, the image formation operation carried out in the full-color mode will be described. The sequence chart in FIG. 4 shows the timings with which the various components in each image formation station are operated immediately before the rotation of the photosensitive drum 1 is stopped in the full-color mode. More specifically, it shows the timing for the rotation of the photosensitive drum 1, the timing for the operation of the pre-exposing apparatus, the timing for the application of the charge bias to the charge roller 2, the timing for exposing the photosensitive drum 1 to form an electrostatic image, the timing for the application of the development bias to the development roller 41, and the timing for the application of the transfer bias to the transfer roller 71. Referring to FIG. 4, the diagonally drawn lines indicates the same area of the peripheral surface of the photosensitive drum 1. For example, a referential symbol B in FIG. 4 denotes the point in time at which the area (image formation area) of the peripheral surface of the photosensitive drum 1, which is to be exposed for image formation, is at the point of pre-exposure.

As the image forming apparatus 100 receives an image formation start command (full-color print signal) when it is in the full-color mode, first, the photosensitive drums 1 in all the image formation stations Sa-Sd begin to be driven. Then, the preparatory operation is sequentially started in all the image formation stations Sa-Sd, starting from the first image formation station Sa. That is, the pre-exposing apparatus 5 is operated to discharge the peripheral surface of the photosensitive drum 1, and the discharged peripheral surface of the photosensitive drum 1 is uniformly charged (to roughly −500 V) by applying the charge bias (roughly −1,000 V) to the charge roller 2. Then, the development roller 41 is rotationally driven, and a preset development bias (roughly −350 V) is applied to the development roller 41. Thereafter, the development roller 41 is placed, while being rotated, in contact with the photosensitive drum 1, by operating the development roller separation mechanism 110. The area of the peripheral surface of the photosensitive drum 1, with which the development roller 41 is to be placed in contact, is charged in advance by the charge roller 2, providing therefore a preset amount of difference in potential between the charged area of the peripheral surface of the photosensitive drum 1 and the development roller 41. Incidentally, the projection of light from the pre-exposing apparatus 5 is started no later than the point in time when the area of the peripheral surface of the photosensitive drum 1, which is to be used for the formation of an electrostatic image, passes by the pre-exposing apparatus.

The preparatory operation, such as the one described above, is sequentially carried out in the first to fourth image formation stations Sa-Sd, starting from the first image formation station Sa, with such timing that coordinates with the timing for the starting of the image formation. Then, the process of exposing the photosensitive drum 1 by the optical system 3 (laser beam scanner) according to the image information is sequentially carried out in the first to fourth image formation stations Sa-Sd, starting from the first image formation station Sa. As a result, an electrostatic image is formed on the peripheral surface of the photosensitive drum 1. Then, the toner on the development roller 41 is supplied to the photosensitive drum 1 in a manner to mirror (reversely) this electrostatic image, developing the electrostatic image into a visible image, or a toner image, that is, an image formed of the toner.

Meanwhile, the transfer medium 10 is supplied to the conveyor belt 70 from a transfer medium feeding station 8. More specifically, in the transfer medium feeding station 8, the transfer mediums 10 (for example, sheets of recording paper) in a cassette 81, as a transfer medium storage, are fed out one by one by a pickup roller 82, and are sent out toward the conveyor belt 70. Then, each transfer medium 10 is temporarily held up by a pair of registration rollers 83. Thereafter, it is released by the pair of registration rollers 83 to be supplied to the conveyor belt 70 in coordination with the delivery of the toner image on the photosensitive drum 1 in the first image formation station Sa, that is, the most upstream image formation station in terms of the moving direction of the conveyor belt 70, to the transfer point N. The transfer medium 10 is borne on the conveyor belt 70 while being electrostatically adhered to the conveyor belt 70 by the function of the adhesion roller 84 as an adhering means.

The transfer medium 10 borne on the conveyor belt 70 is conveyed to the transfer point N of the first image formation station Sa. Then, the toner image on the photosensitive drum 1*a* is transferred onto the transfer medium 10 by the transfer bias (roughly +1,500 V) applied to the transfer roller 71*a*. Not only is the toner image transferred onto the transfer medium 10 by the transfer bias, but also, the potential of the peripheral surface of the photosensitive drum 1*a* is reduced by the transfer bias to roughly −100 V (post-transfer level). Thereafter, the peripheral surface of the photosensitive drum 1*a* is discharged by the pre-exposing apparatus 5 to be reused for image formation.

Also in each of the second-fourth image formation stations Sb-Sd, the toner image is transferred by the transfer bias applied to the transfer roller 71 (71*b*-71*d*), onto the transfer medium 10, while the transfer medium 10 is passed by the transfer point N by the conveyor belt 70. As a result, multiple toner images different in color are layered on the transfer medium 10.

After the transfer medium 10 is conveyed through the fourth image formation station Sd, which is located most downstream in terms of the moving direction of the conveyor belt 70, four toner images, different in color, transferred in layers, are on the transfer medium 10. Then, the transfer medium 10 is conveyed to a fixation station 9, in which the toner images are fixed (welded) to the transfer medium 10. Thereafter, the transfer medium 10 is discharged from the image forming apparatus main assembly A.

After the completion of the image formation in each of the image formation stations Sa-Sd, the pre-exposing apparatus 5 is turned off, the charge bias is turned off, and the transfer bias is turned off, in each of the image formation stations Sa-Sd. Further, the development roller separation mechanism 110 is activated to separate the development roller 41 from the photosensitive drum 1. Then, the rotation of the photosensitive drum 1 is stopped, ending the image formation process. Incidentally, when stopping the image forming apparatus 100 after the completion of an image forming operation carried out in the full-color mode, the rotational driving of the photosensitive drum 1 is stopped without activating the transfer belt separation mechanism 71, in other words, with the conveyor belt 70 kept in contact with the photosensitive drum 1 (first mode).

Figure 5:
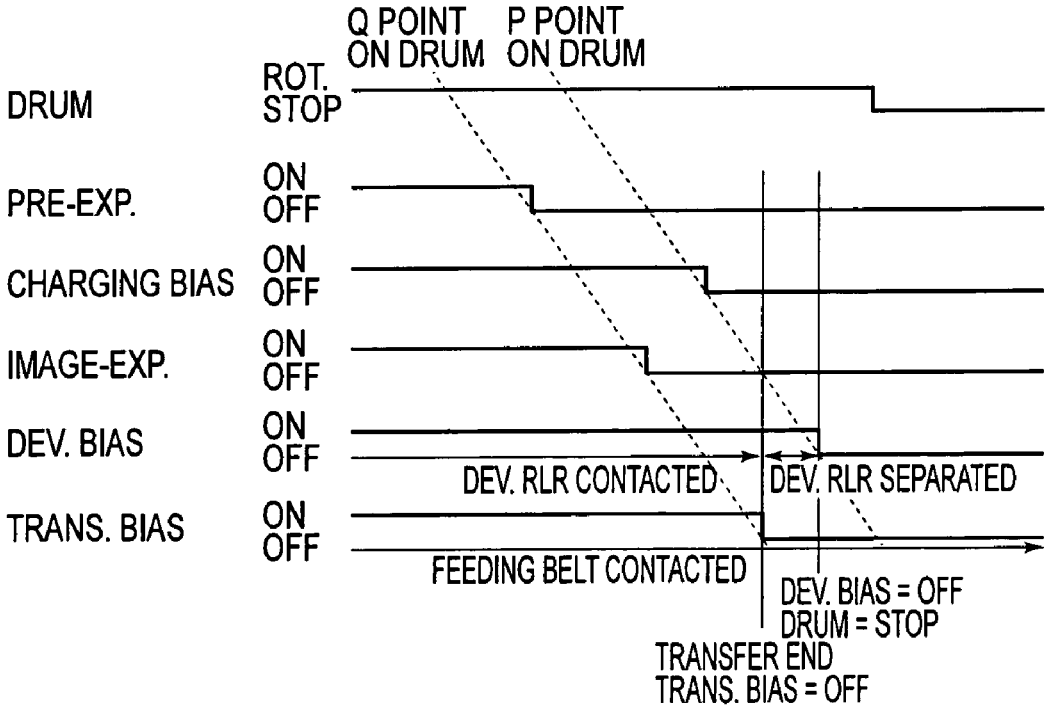
FIG. 5 is also a diagram showing the durations and timings of the operations carried out by the various components of an image forming apparatus when the apparatus is in a mode in which the operation for separating the transferring apparatus from the photosensitive drum is not carried out.

FIG. 5 is a sequence chart which shows in more detail the timings with which the various components of the image forming apparatus are operated immediately prior and after the completion of an image forming operation. In this embodiment, in order to reduce the amount of the deterioration of the photosensitive drum 1 attributable to its exposure to light, the illumination of the photosensitive drum 1 by the pre-exposing apparatus is stopped (point Q) immediately after the area of the peripheral surface of the photosensitive drum 1, which is to be used for the formation of an electrostatic image, passes by the pre-exposing apparatus 5. Further, in order to prevent the vibrations, which occur when the development roller 41 is separated from the photosensitive drum 1, from affecting the quality with which images are formed, the development roller separation mechanism 110 is operated to separate the development roller 41 from the photosensitive drum 1 in each image formation station, after all the toner images on the photosensitive drums 1 are transferred onto the transfer medium 10. Further, in order to prevent the formation of images suffering from the "fog" caused by the adhesion of toner to the wrong points of the peripheral surface of the photosensitive drum 1, it is necessary to provide a preset amount of difference in potential between the development roller 41 and photosensitive drum 1, while the development roller 41 is in contact with the photosensitive drum 1. Therefore, the application of the charge bias to the charge roller 2 continues to charge the photosensitive drum 1 until the point (P) of the peripheral surface of the photosensitive drum 1, which is expected to be in the interface between the development roller 41 and photosensitive drum 1 at the very moment when the development roller 41 separates from the photosensitive drum 1, reaches the charge roller 2. Then, as soon as the development roller 41 separates from the photosensitive drum 1, the charge bias for charging the peripheral surface of the photosensitive drum 1 is turned off.

(Monochromatic Mode)

Next, the image formation operation carried out in the monochromatic mode will be described.

Referring to FIG. 3, when the image forming apparatus 100 is operated in the monochromatic mode, the conveyor belt 70 is separated from the photosensitive drums 1*a*-1*c* by operating the belt separation mechanism 72 to separate the transfer roller 71 from the photosensitive drum 1, in each of the first-third image formation stations Sa-Sc. Also in the monochromatic mode, the development roller 41*a*-41*c* are separated from the photosensitive drum 1*a*-1*c* by the development roller separation mechanisms 110*a*-110*c*, respectively.

Black monochromatic images are formed (printed) in the fourth image formation station Sd, while keeping the operations of the process cartridges Ba-Bc of the first-third image formation stations Sa-Sc suspended. In other words, in the monochromatic mode, the rotation of the photosensitive drum 1, the rotation of the rotational members (development roller 41 and supply roller 42) in the developing device 4, and the rotation of the charge roller 2 are suspended in each of the first-third image formation stations Sa-Sc. Suspending the rotation of the photosensitive drum 1, the rotation of the rotational members (development roller 41 and supply roller 42) in the developing device 4, and the rotation of the charge roller 2 prevents the shaving of the photosensitive drum 1, for example, the shaving of the photosensitive drum 1 by the cleaning blade 61. Therefore, it can extend the life of the process cartridge B.

First, the image forming apparatus 100 receives an image formation start command (monochromatic print signal) when it is in the monochromatic mode. If the conveyor belt 70 is in contact with all the photosensitive drum 1 in all of the first-fourth image formation stations Sa-Sd (for example, if image forming apparatus 100 has just been operated in full-color mode), first, the operation for separating the conveyor belt 70 from the photosensitive drum 1 is carried out in the image formation stations Sa-Sc. Then, an image formation operation similar to the one carried out in the above-described full-color mode is carried out only in the fourth image formation station Sd to form a black monochromatic image on the transfer medium 10.

Incidentally, the operation for placing the conveyor belt 70 in contact with the photosensitive drum 1 and the operation for separating conveyor belt 70 from the photosensitive drum 1 can be carried out even while the conveyor belt 70 is driven. However, driving the conveyor belt 70 while the conveyor belt 70 is in contact with the photosensitive drum 1 which is sometimes kept stationary causes the conveyor belt 70 to leaves scratch marks on the peripheral surface of the photosensitive drum 1, which sometimes results in the formation of flawed images. Thus, it is desired that when the operation for placing the conveyor belt 70 in contact with the photosensitive drum 1, or separating the conveyor belt 70 from the photosensitive drum 1, both the conveyor belt 70 and photosensitive drum 1 are being driven, or kept stationary.

(Transition from Full-Color Mode to Monochromatic Mode)

Next, a case in which the image forming apparatus described above is operated in the monochromatic mode immediately after it is operated in the full-color mode will be described.

As described above, the conveyor belt 70 of the above-described image forming apparatus having the mechanism for separating the conveyor belt 70 from the photosensitive drum 1 is separated from the photosensitive drum 1 as necessary. However, separating the conveyor belt 70 from the charged area of the peripheral surface of the photosensitive drum 1 sometimes triggers electric discharge (which hereafter will be referred to separation discharge) between the conveyor belt 70 and photosensitive drum 1 at the moment of the separation, rendering thereby this charged area of the peripheral surface of the photosensitive drum 1 to be nonuniform in potential. This nonuniformity in potential sometimes affects the immediately following image formation operation and thereafter.

Thus, one of the primary objects of the present invention is to carry out the operation for separating the transferring apparatus from the photosensitive drums, without causing an image forming apparatus to form flawed images, the flaws of which are attributable to the above-mentioned separation discharge. Another object of the present invention is to optimize the timing (operational timing) with which the discharging apparatus is separated, according to the mode in which the transferring apparatus is separated from the photosensitive drums. Further, another object of the present invention is to reduce the amount of the photo-induced deterioration of the photosensitive drum 1.

In this embodiment, in order to accomplish the above-described objects, the transfer separation area (separation discharge area) of the peripheral surface of the photosensitive drum 1, which is highly likely to trigger the separation discharge, is discharged by the pre-exposing apparatus 5, which is a discharging apparatus (pre-exposing means), to prevent the following image formation operations from being affected by the separation discharge. More specifically, in this embodiment, the operational sequences of the pre-exposing apparatus 5 and photosensitive drum 1 are optimized according to the mode in which the conveyor belt 70 is separated from the photosensitive drum 1. Then, the driving of the photosensitive drum 1 is stopped after the transfer separation area of the peripheral surface of the photosensitive drum 1, which has possibly been subjected to the electric discharge, is discharged. In particular, this embodiment relates to the timing with which the conveyor belt 70 is separated from the photosensitive drum 1 immediately after the image forming apparatus is switched in operational mode from the full-color mode to the monochromatic mode, and the operations carried out by the pre-exposing apparatus 5 at the time of the mode switch.

Figure 6:
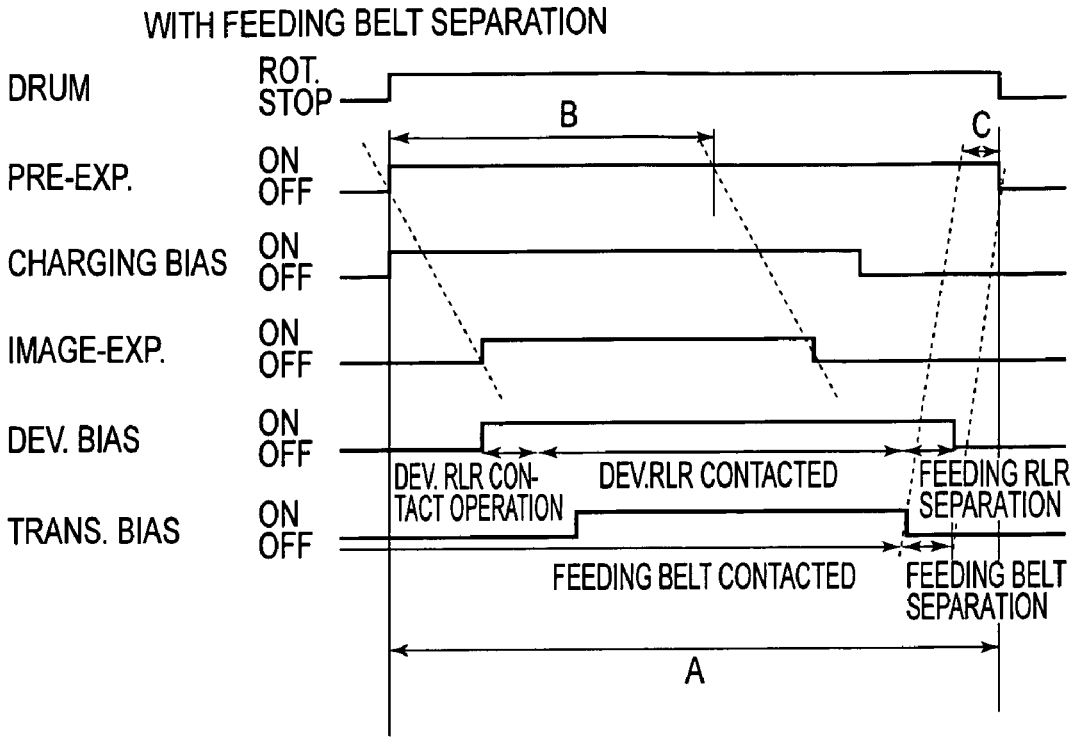
FIG. 6 is a diagram showing the durations and timings of the operations carried out by the various components of an image forming apparatus when the apparatus is in a mode in which the operation for separating the transferring apparatus from the photosensitive drum is carried out.
Figure 7:
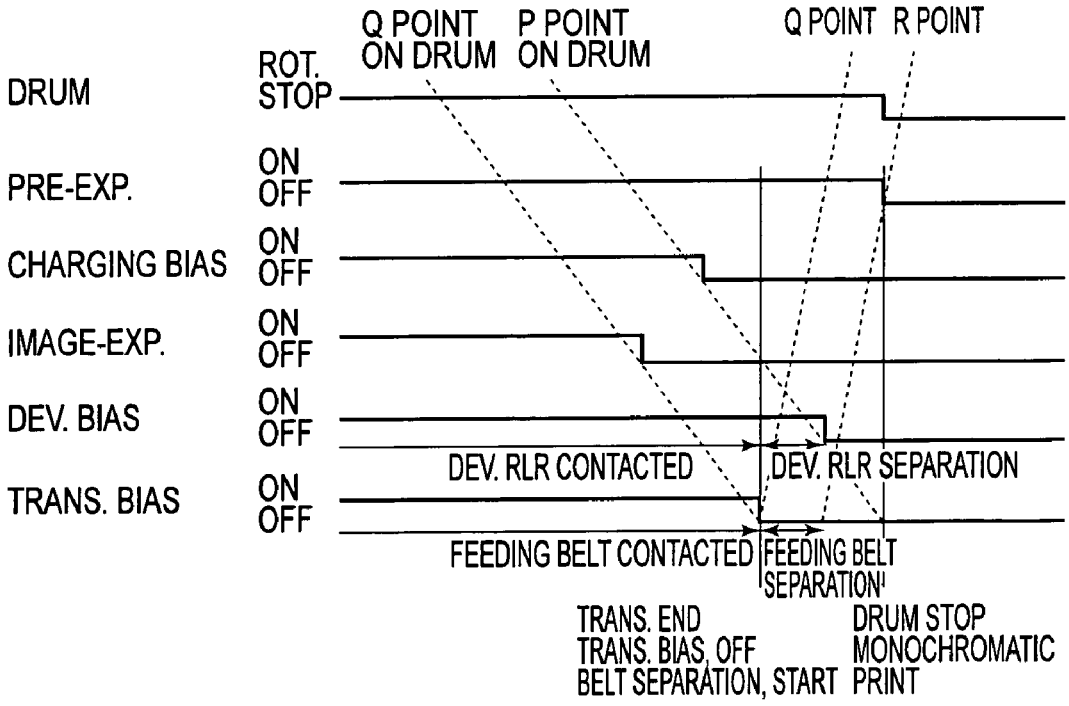
FIG. 7 is also a diagram showing the durations and timings of the operations carried out by the various components of an image forming apparatus when the apparatus is in a mode in which the operation for separating the transferring apparatus from the photosensitive drum is carried out.

The sequence chart shown in FIG. 6 shows the operational timing with which the conveyor belt 70 is separated from the photosensitive drum 1 in each of the first-third image formation stations Sa-Sc, immediately after the image forming apparatus is switched in operational mode from the full-color mode to the monochromatic mode. More specifically, it shows the timing for the rotation of the photosensitive drum 1, the timing for the operation of the pre-exposing apparatus 5, the timing for the application of the charge bias to the charge roller 2, the timing for the formation of an electrostatic image (timing for image formation exposure), the timing for the application of the development bias to the development roller 41, and the timing for the application of the transfer bias to the transfer roller 71. Referring to FIG. 6, the diagonal lines indicate the same area of the peripheral surface of the photosensitive drum 1. For example, a referential symbol B in FIG. 6 denotes the timing with which the area (image formation area) of the peripheral surface of the photosensitive drum 1, which is to be exposed for the formation of an electrostatic image, is at the pre-exposure point. A referential symbol C in FIG. 6 denotes the point in time at which the point of the peripheral surface of the photosensitive drum, which was at the transferring point when the operation for separating the conveyor belt 70 from the photosensitive drum 1 was started, is at the point of the pre-exposure. FIG. 7 is a sequence chart which shows in more detail the timings with which the above-mentioned operations are carried out immediately before and after the separation.

First, a full-color image is formed on the transfer medium 10 through an image formation process, which is similar to the image formation process carried out when the image forming apparatus was in the above-mentioned full-color mode.

Then, near the end of the image formation operation, the charge biases applied in the first-third image formation stations S1-Sc are sequentially turned off, and the transfer biases applied in the first-third image formation stations Sa-Sc are also sequentially turned off. Further, the development roller 41 is separated from the photosensitive drum 1, in the first-third image formation stations Sa-Sc, and the conveyor belt 70 is separated from the photosensitive drums 1 in the first-third image formation stations Sa-Sc. Then, the illumination of the photosensitive drum 1 by the pre-exposing apparatus 5 is stopped, as will be described later in detail. Also in the first-third image formation stations Sa-Sc, the rotational driving of the photosensitive drum 1 is stopped (second mode) after the transfer belt separation mechanism 72 is operated to separate the conveyor belt 70 from the photosensitive drum 1. This concludes the image formation operation in the full-color mode.

In the fourth image formation station Sd, as the image formation operation in the full-color mode ends, the illumination of the photosensitive drum by the pre-exposing apparatus 5 is stopped, and the charge bias is turned off, and the transfer bias is turned off, as they are in the above-described full-color mode. On the other hand, the development roller 41 is kept in contact with the photosensitive drum 1, the conveyor belt 70 is kept in contact with the photosensitive drum 1, and the rotation of the photosensitive drum 1 is continued.

Also in the fourth image formation station Sd, an image formation process similar to the one carried out in the above-described monochromatic mode is carried out to form a black monochromatic image on the transfer medium 10. Thereafter, in the image formation station Sd, the rotational driving of the photosensitive drum 1 is stopped, without operating the belt separation mechanism 72, and therefore, with the conveyor belt 70 kept in contact with the photosensitive drum 1 (first mode).

Here, the first mode is different from the second mode, in terms of the length of time between the point in time at which the area of the peripheral surface of the photosensitive drum 1, across which an electrostatic image is to be formed immediately before the image bearing member is stopped, passes by the discharging point, and the point in time at which the discharging apparatus is stopped for the last time before the photosensitive drum 1 is stopped. In this embodiment, the first mode is rendered different from the second mode in terms of the length of the time measured from the point in time at which the leading edge of the image formed immediately before the photosensitive drum is stopped, passes by the pre-exposing apparatus 5, to the point in time at which the illumination by the pre-exposing apparatus 5 is stopped for the last time. In other words, the operation mode (A in FIG. 4) in which the conveyor belt 70 is not separated from the photosensitive drum 1 is different from the operational mode (A in FIG. 6) in which conveyor belt 70 is separated from the photosensitive drum 1, in terms of the length of time between the point in time at which the leading edge of the image formed immediately before the photosensitive drum is stopped, passes by the pre-exposing apparatus 5 and the point in time at which the illumination by the pre-exposing apparatus 5 is stopped. This is for the following reason. That is, only the area of the peripheral surface of the photosensitive drum 1, which is to be exposed in the mode in which the conveyor belt 70 is not separated from the photosensitive drum 1, is the area (B in FIG. 4) of the peripheral surface of the photosensitive drum 1, which is to be used for the formation of the last image; in other words, the pre-exposure may be stopped even immediately after this area is exposed. On the other hand, when the image forming apparatus is operated in the mode in which the conveyor belt 70 is separated from the photosensitive drum 1, the pre-exposing apparatus is not be stopped until the area of the peripheral surface of the photosensitive drum 1, which is in contact with the conveyor belt 70 at the moment when the conveyor belt 70 is separated from the photosensitive drum 1, is exposed. In this embodiment, while the conveyor belt 70 is separated from the photosensitive drum 1, the pre-exposing apparatus 5 is kept on (with no interruption) to illuminate the photosensitive drum 1 until it is turned off for the last time before the photosensitive drum 1 is stopped.

Incidentally, in this embodiment, the point in time at which the discharging apparatus is to be stopped for the last time is set with reference to the point in time (point zero) at which the leading edge (in terms of moving direction of peripheral surface of photosensitive drum 1) of the area of the peripheral surface of the photosensitive drum 1, across which an image (electrostatic image: toner image) is to be formed immediately before the photosensitive drum 1 is stopped, passes by the pre-exposing apparatus 5 before the pre-exposing apparatus is turned of for the last time. Obviously, when comparing the first and second modes in terms of the length of this period of time, it is assumed that the two modes are practically the same in the peripheral velocity of the photosensitive drum 1, and the length of an image in terms of the moving direction of the peripheral surface of the photosensitive drum 1. However, the above-described embodiment is not intended to limit in scope the present invention. That is, as long as the two modes can be compared in terms of the length of time from when the area of the peripheral surface of the photosensitive drum 1, across which an electrostatic image is to be formed immediately before the image bearing member is stopped, passes by the discharging point, to when the discharging apparatus is stopped for the last time before the photosensitive drum 1 is stopped, any point in time may be used as the referential point in time.

Figure 8:
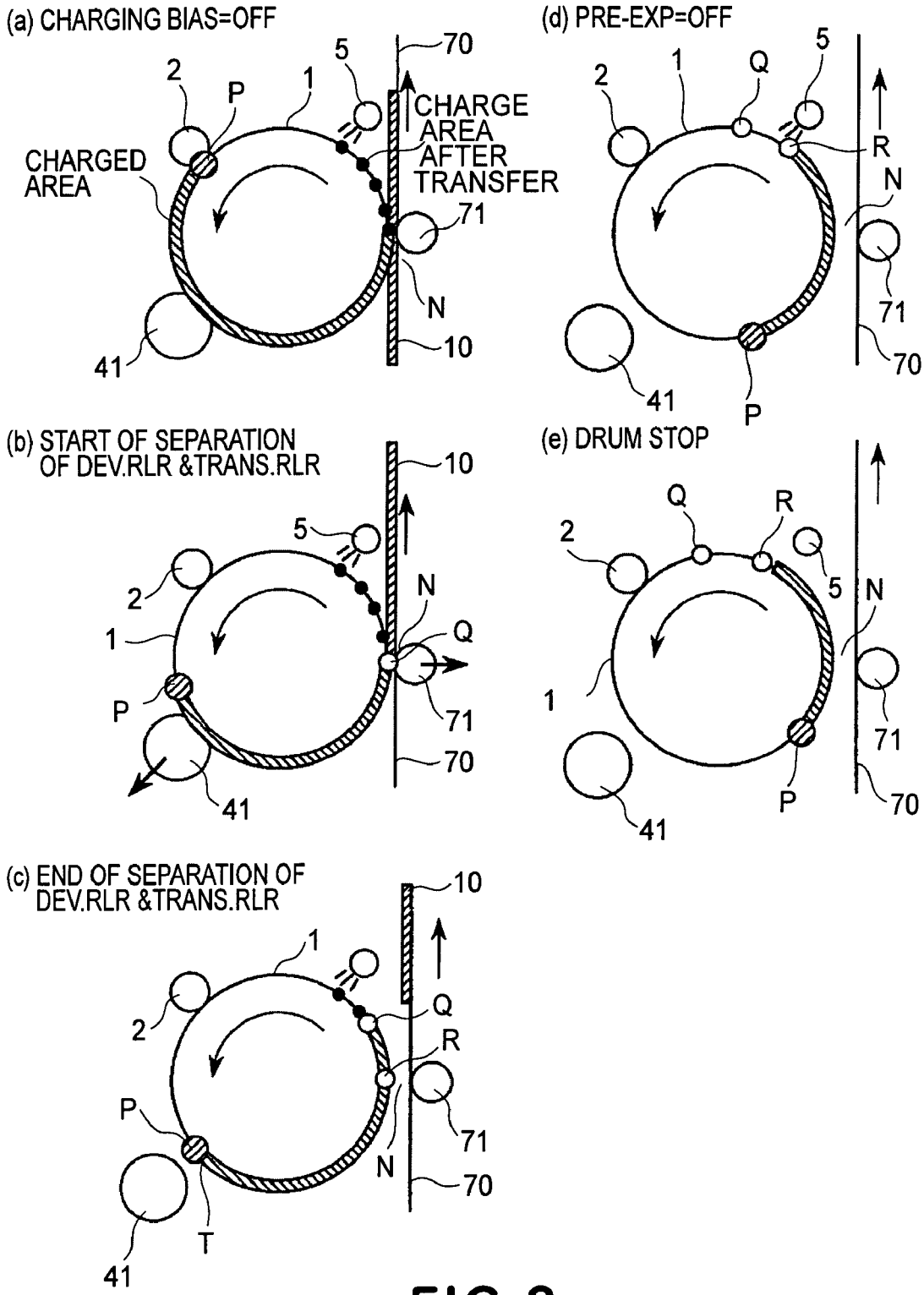
FIG. 8 is a schematic drawing showing an example of the operation of the pre-exposing apparatus, which is in accordance with the present invention.

Next, referring to FIG. 8, the timings with which the various components in the first-third image formation stations Sa-Sc are operated immediately before and after the ending of the image forming operation in the full-color mode will be described in more detail. FIG. 8 schematically shows the operations of the various elements located in the adjacencies of the peripheral surface of the photosensitive drum 1, which are carried out immediately before and after the ending of the image forming operation in the first-third image formation stations Sa-Sc.

Referring to FIG. 8(*a*), the charge bias is turned off after the area of the peripheral surface of the photosensitive drum 1, which is to be used for image formation, passes by the charge roller 2, near the end of the image forming operation. In FIG. 8(*a*), a referential symbol P denotes the point of the peripheral surface of the photosensitive drum 1, which is at the charging point (at which photosensitive drum 1 is charged by charge roller 2) when the charge bias is turned off, and a referential symbol T (FIG. 8(*c*)) denotes the point of the peripheral surface of the photosensitive drum 1, which is at the development point when the operation for separating the development roller 41 from the photosensitive drum 1, which is started after all the toner images are transferred onto the transfer medium 10, is completed. In terms of the moving direction of the peripheral surface of the photosensitive drum 1, the point P is located at least upstream of the point T. Therefore, the area of the peripheral surface of the photosensitive drum 1, which is located downstream of the point P, in terms of the moving direction of the peripheral surface of the photosensitive drum 1, retains the charge given by the charge bias, whereas the area of the peripheral surface of the photosensitive drum 1, which is located upstream of the point P in terms of the moving direction of the peripheral surface of the photosensitive drum 1, has been reduced in potential by the transfer bias.

Next, referring to FIG. 8(*b*), after all the toner images on the photosensitive drums 1 are transferred onto the transfer medium 10, the transfer bias is turned off, and the operation for separating the development roller 41 and conveyor belt 70 from the photosensitive drum 1 is started. Next, referring to FIG. 8(*c*), by the time when the point P passes by the developing point, the operation for separating the development roller 41 from the photosensitive drum 1 is completed. Therefore, the area of the peripheral surface of the photosensitive drum 1, which is located downstream of the point P in terms of the moving direction of the peripheral surface of the photosensitive drum 1, remains charged. Therefore, even if the development roller 41, to which a preset development bias is being applied, is in contact with this area of the photosensitive drum 1, it does not occur that images suffering from "fog" are formed. The development bias is turned off after the completion of the operation for separating the development roller 41 from the photosensitive drum 1. The operation for separating the conveyor belt 70 from the photosensitive drum 1 ends about the same time as the completion of the operation for separating the development roller 41 from the photosensitive drum 1.

Also referring to FIG. 8, a referential symbol Q denotes the point of the peripheral surface of the photosensitive drum 1, which is at the transfer point N when the operation for separating the conveyor belt 70 from the photosensitive drum 1 is started, and a referential symbol R denotes the point of the peripheral surface of the photosensitive drum 1, which is at the transfer point N when the operation for separating the conveyor belt 70 from the photosensitive drum 1 ends. In this embodiment, the point Q is such a point of the peripheral surface of the photosensitive drum 1 that will be located at the transfer point N at the completion of the transfer of the toner image on the photosensitive drum 1 onto the transfer medium 10.

The area of the peripheral surface of the photosensitive drum 1, which is between the points Q and R, retains the charge given by the charge bias. In other words, the operation for separating the conveyor belt 70 from the photosensitive drum 1 separates the conveyor belt 70 from the area of the peripheral surface of the photosensitive drum 1, which retains the charge given by the charge bias. Therefore, electric discharge (aforementioned separation discharge) sometimes occurs between the conveyor belt 70 and photosensitive drum 1 when the conveyor belt 70 is separated from the photosensitive drum 1. If the photosensitive drum 1 is left as it is, after the occurrence of this separation discharge, a memory is sometimes effected on the peripheral surface of the photosensitive drum 1 by the nonuniform potential of the peripheral surface of the photosensitive drum 1.

In this embodiment, therefore, the area of the peripheral surface of the photosensitive drum 1, which has passed by the transfer point N during the operation for separating the conveyor belt 70 from the photosensitive drum 1, that is, while the belt separation mechanism 72 is operated, in other words, the area of the peripheral surface of the photosensitive drum 1, which is between the points Q and R, is discharged by the pre-exposing apparatus 5. In other words, the area of the peripheral surface of the photosensitive drum 1, which is between the points Q and R, that is, the area of the peripheral surface of the photosensitive drum 1, which is where the separation discharge possibly occurred between the photosensitive drum 1 and conveyor belt 70, is discharged.

This embodiment is characterized in that, near the end of the image forming operation in the full-color mode, the pre-exposing apparatus 5 is kept on at least until the point R passes by the discharging point N of the pre-exposing apparatus 5 (at which point R opposes pre-exposing apparatus 5). Then, the illumination by the pre-exposing apparatus 5 is stopped after the point R passes by the charge removal point N, at which the peripheral surface of the photosensitive drum 1 is discharged by the pre-exposing apparatus 5, as shown in FIG. 8(*d*). Thereafter, the rotation of the photosensitive drum 1 is stopped as shown in FIG. 8(*e*).

As described above, when the operation for separating the conveyor belt 70 from the photosensitive drum 1 is carried out, the length of time measured from the point in time at which the leading edge of the toner image passes by the pre-exposing apparatus 5 to the point in time at which the pre-exposing apparatus 5 is turned off is longer than when the operation for separating the conveyor belt 70 from the photosensitive drum 1 is not carried out. In other words, from the standpoint of reducing the amount of the photo-induced deterioration of the photosensitive drum 1, when the operation for separating the conveyor belt 70 from the photosensitive drum 1 is not carried out, the pre-exposing apparatus 5 is turned off immediately after the area of the peripheral surface of the photosensitive drum 1, which is to be used for the formation of an electrostatic image, passes by the pre-exposing apparatus 5 (FIGS. 4 and 5). On the other hand, when the operation for separating the conveyor belt 70 from the photosensitive drum 1 is carried out, the pre-exposing apparatus 5 is kept on even after the area of the peripheral surface of the photosensitive drum 1, which is to be used for the formation of an electrostatic image, passes by the pre-exposing apparatus 5. Then, it is turned off after the point R passes by the pre-exposing apparatus 5 (FIGS. 5 and 6).

In this embodiment, the area (separation discharge area) of the peripheral surface of the photosensitive drum 1, which is between the points Q and R, is discharged by the pre-exposing apparatus 5. Therefore, even if the photosensitive drum 1 is left as it is, it does not occur that the trace of the separation discharge is effected as a memory which affects the quality with which images will be formed in the following image formation operations. Further, the operation for separating the conveyor belt 70 from the photosensitive drum 1 can be carried out immediately after the completion of the transfer operation. Therefore, the image forming apparatus 100 can be quickly switched from the full-color mode to the monochromatic mode. Further, the operational time (timing) for the pre-exposing apparatus 5 can be optimized according the mode of the operation for separating the conveyor belt 70 from the photosensitive drum 1. Therefore, it is possible to reduce the amount of the photo-induced deterioration of the photosensitive drum 1, while preventing the problems attributable to the separation discharge resulting from the operation for separating the conveyor belt 70 from the photosensitive drum 1.

As described above, this embodiment makes it possible to prevent the image forming apparatus having the mechanism for separating the conveyor belt 70 from the photosensitive drum 1, from forming flawed images, the flaws of which are attributable to the separation discharge which occurs when the conveyor belt 70 separates from the photosensitive drum 1.

Embodiment 2

Next, another embodiment of the present invention will be described. The basic structure of the image forming apparatus in this embodiment is the same as that in the first embodiment. Thus, its components which are identical or equivalent in function and structure to those of the image forming apparatus in the first embodiment are given the same referential symbols as those given for the description of the first embodiment, and will be not be described in detail. Hereafter, only the characteristic features of the image forming apparatus in this embodiment will be described.

The exposure of the photosensitive drum 1 to light for an extended length of time causes the photo-induced deterioration of the photosensitive drum 1, which sometimes causes the photosensitive drum 1 to degrade in sensitivity, and/or results in the formation of latent images which are aberrant in potential. This sometimes causes the image forming apparatus to form flawed images. Therefore, the length of time for which the peripheral surface of the photosensitive drum 1 is exposed to the pre-exposure light is desired to be as short as possible.

In this embodiment, therefore, only the area of the peripheral surface of the photosensitive drum 1, which is between the points Q an R, that is, the area of the peripheral surface of the photosensitive drum 1, which is where the separation discharge sometimes occurs, is exposed to the pre-exposure light. That is, as in the first embodiment, the length of time measured from the point in time at which the leading edge of the image passes by the pre-exposing apparatus 5, to the point in time at which the illumination of the photosensitive drum 1 by the pre-exposing apparatus 5 is stopped for the last time before the photosensitive drum 1 is stopped, is longer when the operation for the conveyor belt 70 from the photosensitive drum 1 is carried out than when the operation for separating the conveyor belt 70 from the photosensitive drum 1 is not carried out. In this embodiment, however, a period in which the pre-exposing apparatus 5 is temporarily turned off is provided before the pre-exposing apparatus 5 is turned off for the last time before the photosensitive drum 1 is stopped. In other words, after the area of the peripheral surface of the photosensitive drum 1, across which the last image (electrostatic image: toner image) is to be formed before the photosensitive drum 1 is stopped, is discharged, the pre-exposing apparatus 5 is temporarily turned off. Then, when the separation discharge area (area between points Q and R) reaches the exposure point, the pre-exposing apparatus 5 is turned on to discharge the separation discharge area. Therefore, the life of the photosensitive drum 1 is extended while the amount of the photo-induced deterioration of the photosensitive drum 1 is reduced.

Figure 9:
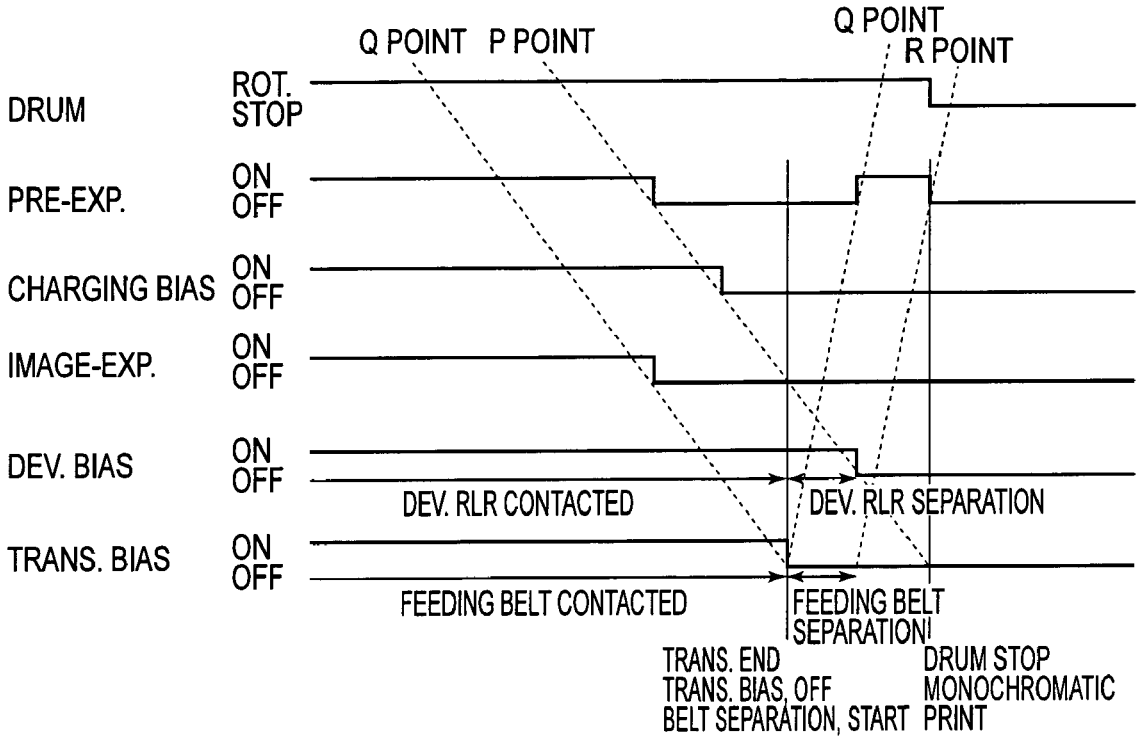
FIG. 9 is a diagram showing the durations and timings of the operations carried out by the various components of another image forming apparatus when the apparatus is in a mode in which the operation for separating the transferring apparatus from the photosensitive drum is carried out.
Figure 10:
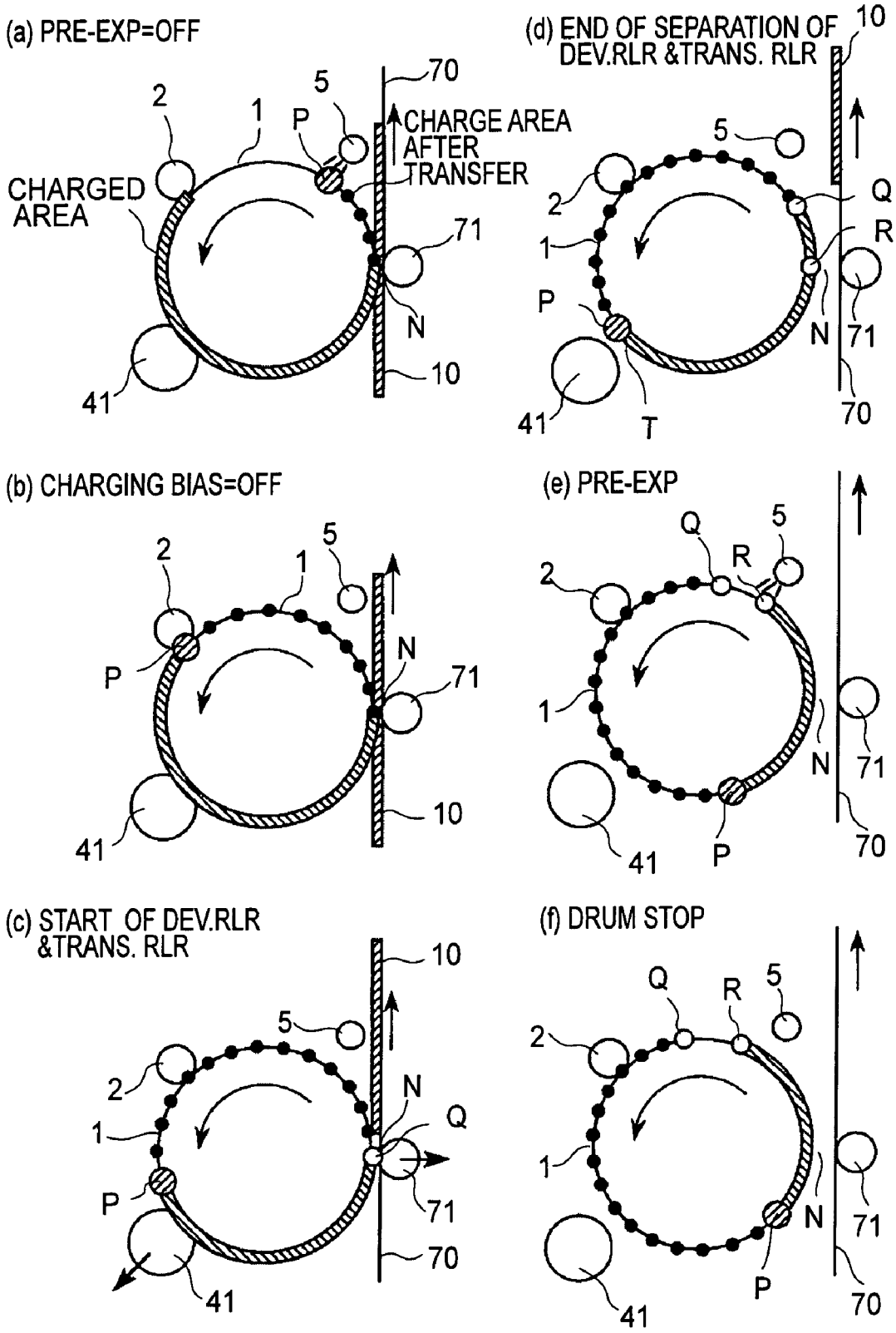
FIG. 10 is a schematic drawing showing another example of the operation of the pre-exposing apparatus, which is in accordance with the present invention.

The sequence chart in FIG. 9 shows the operational timings of the various components in the first-third image formation stations Sa-Sc, in which the conveyor belt 70 is separated from the photosensitive drum 1 when the image forming apparatus is switched in operational mode from the full-color mode to the monochromatic mode. FIG. 10 schematically shows the movements of the various components in the adjacencies of the peripheral surface of the photosensitive drum 1, which occur in the first-third image formation stations Sa-Sc immediately before and after the end of an image forming operation in the full-color mode.

When the image forming apparatus is operated, in succession, in the full-color mode and monochromatic mode, first, a full-color image is formed on the transfer medium 10 through the image formation process mentioned above regarding the description of the first embodiment.

Then, after the conveyor belt 70 is separated from the photosensitive drum 1 in each of the first-third image formation stations Sa-Sc, the rotation of the photosensitive drum 1 is stopped (second mode), ending thereby the image formation operation in the full-color mode.

That is, referring to FIG. 10(*a*), the illumination of the photosensitive drum 1 by the pre-exposing apparatus 5 is stopped in the first-third image formation stations Sa-Sc after the area of the peripheral surface of the photosensitive drum 1, which is to be used for image formation, passes by the pre-exposing apparatus 5, near the end of the image formation operation in the full-color mode. In FIG. 10, a referential symbol P denotes the point of the peripheral surface of the photosensitive drum 1, which opposes the pre-exposing apparatus 5, when the illumination by the pre-exposing apparatus 5 is stopped, that is, the point of the peripheral surface of the photosensitive drum 1, which is at the discharging point of the pre-exposing apparatus 5 when the illumination by the pre-exposing apparatus 5 is stopped. A referential symbol T (FIG. 10(*d*)) denotes the point of the peripheral surface of the photosensitive drum 1, which is located at the development point when the operation for separating the development roller 41 from the photosensitive drum 1, which is started after the completion of the transfer of all the toner images onto the transfer medium 10, ends. The point P is located at least upstream of the point T in terms of the moving direction of the peripheral surface of the photosensitive drum 1. Referring to FIG. 10(*b*), the charge bias is turned off when the point P passes by the charge roller 2. That is, in this embodiment, the area of the peripheral surface of the photosensitive drum 1, which is to be charged by the charge bias, is illuminated by the pre-exposing apparatus 5, whereas the area of the peripheral surface of the photosensitive drum 1, which does not need to be charged by the charge bias, is not illuminated by the pre-exposing apparatus 5. In other words, in this embodiment, the illumination by the pre-exposing apparatus 5 is temporarily stopped to minimize the amount of the photo-induced deterioration of the photosensitive drum 1, in order to extend the life of the photosensitive drum 1. Therefore, the area of the peripheral surface of the photosensitive drum 1, which is downstream of the point P in terms of the moving direction of the peripheral surface of the photosensitive drum 1, retains the electric charge given by the charge bias, whereas the area of the peripheral surface of the photosensitive drum 1, which is upstream of the point P in terms of the moving direction of the peripheral surface of the photosensitive drum 1, remains lower in potential level (because its potential is reduced by transfer bias).

Next, referring to FIG. 10(*c*), after the completion of the transfer of all the toner images on the photosensitive drums 1 onto the transfer medium 10, the transfer bias is turned off, and the operation for separating the development roller 41 and conveyor belt 70 from the photosensitive drum 1 is started. By the time the point P passes by the development point, the operation for separating the development roller 41 from the photosensitive drum 1 ends, as shown in FIG. 10(*d*). Therefore, the area of the peripheral surface of the photosensitive drum 1, which is downstream of the point P in terms of the moving direction of the peripheral surface of the photosensitive drum 1, remains charged. Therefore, even if the development roller 41, to which a preset development bias is being applied, contacts this area, it does not occur that images suffering from "fog" are formed. After the operation for separating the development roller 41 from the photosensitive drum 1 ends, the development bias is turned off. The operation for separating the conveyor belt 70 from the photosensitive drum 1 ends at approximately the same time as the completion of the operation for separating the development roller 41 from the photosensitive drum 1.

A referential symbol Q denotes the point of the peripheral surface of the photosensitive drum 1, which is at the transfer point N when the operation for separating the conveyor belt 70 from the photosensitive drum 1 is started, and a referential symbol R denotes the point of the peripheral surface of the photosensitive drum 1, which is at the transfer point N when the operation for separating the conveyor belt 70 from the photosensitive drum 1 ends. In this embodiment, the point Q is such a point of the peripheral surface of the photosensitive drum 1 that is at the transfer point N at the completion of the transfer of the toner image on the photosensitive drum 1 onto the transfer medium 10.

The area of the peripheral surface of the photosensitive drum 1, which is between the points Q and R, retains the charge given by the charge bias, as in the first embodiment. Therefore, the operation for separating the conveyor belt 70 from the photosensitive drum 1 separates the conveyor belt 70 from the area of the peripheral surface of the photosensitive drum 1, which retains the charge given by the charge bias.

In this embodiment, therefore, the pre-exposing apparatus 5 is reactivated when the area of the peripheral surface of the photosensitive drum 1, which has passed by the transfer point N, passes by the discharging point (point at which peripheral surface of photosensitive drum 1 opposes pre-exposing apparatus 5) of the pre-exposing apparatus 5, during the operation for separating the conveyor belt 70 from the photosensitive drum 1. That is, in this embodiment, the pre-exposing apparatus 5 is reactivated when the area of the peripheral surface of the photosensitive drum 1, which is between the points Q and R, that is, the area of the peripheral surface of the photosensitive drum 1, which has passed by the transfer point N when the belt separation mechanism 72 is in operation, passes by the pre-exposing apparatus 5. Therefore, the area of the peripheral surface of the photosensitive drum 1, which is between the points Q and R, that is, the area of the peripheral surface of the photosensitive drum 1, which is where electric discharge has possibly occurred between the photosensitive drum 1 and conveyor belt 70. Then, after the point R passes by the discharging point of the pre-exposing apparatus 5, the illumination by the pre-exposing apparatus 5 is stopped. Thereafter, the rotation of the photosensitive drum 1 is stopped as shown in FIG. 10(*f*).

Incidentally, in the fourth image formation station Sd, the operation for forming a black monochromatic image on the transfer medium 10 is continued as in the first embodiment.

In this embodiment, the area (separation discharge area) of the peripheral surface of the photosensitive drum 1, which is between the points Q and R, is discharged by the pre-exposing apparatus 5. Therefore, even if the photosensitive drum 1 is left as it is, it does not occur that the trace of the electric discharge remains, as a memory, on the photosensitive drum 1 and affects the quality with which images are formed in the following image formation operations. Further, only the area of the peripheral surface of the photosensitive drum 1, which is between the points Q and R, is illuminated with the pre-exposure light. Therefore, the life of the photosensitive drum 1 can be extended while minimizing the amount of the photo-induced deterioration of the photosensitive drum 1. Further, the operation for separating the conveyor belt 70 from the photosensitive drum 1 can be started immediately after the completion of the transfer operation. Therefore, the operational mode can be more quickly switched from the full-color mode to the monochromatic mode.

Incidentally, in the two embodiments described above, the transfer separation area (separation discharge area) was defined as the area of the peripheral surface of the photosensitive drum 1, which is between the points Q and R. This definition is not intended to limit in scope the present invention. For example, the point Q, which corresponds to the point in time at which the conveyor belt 70 begins to separate from the photosensitive drum 1. Therefore, the point Q is the point at which the separation discharge is most likely to occur between the conveyor belt 70 and photosensitive drum 1. Therefore, the above-described effects of the present invention can be realized by discharging at least the point Q of the photosensitive drum 1 before stopping the photosensitive drum 1.

Figure 11:
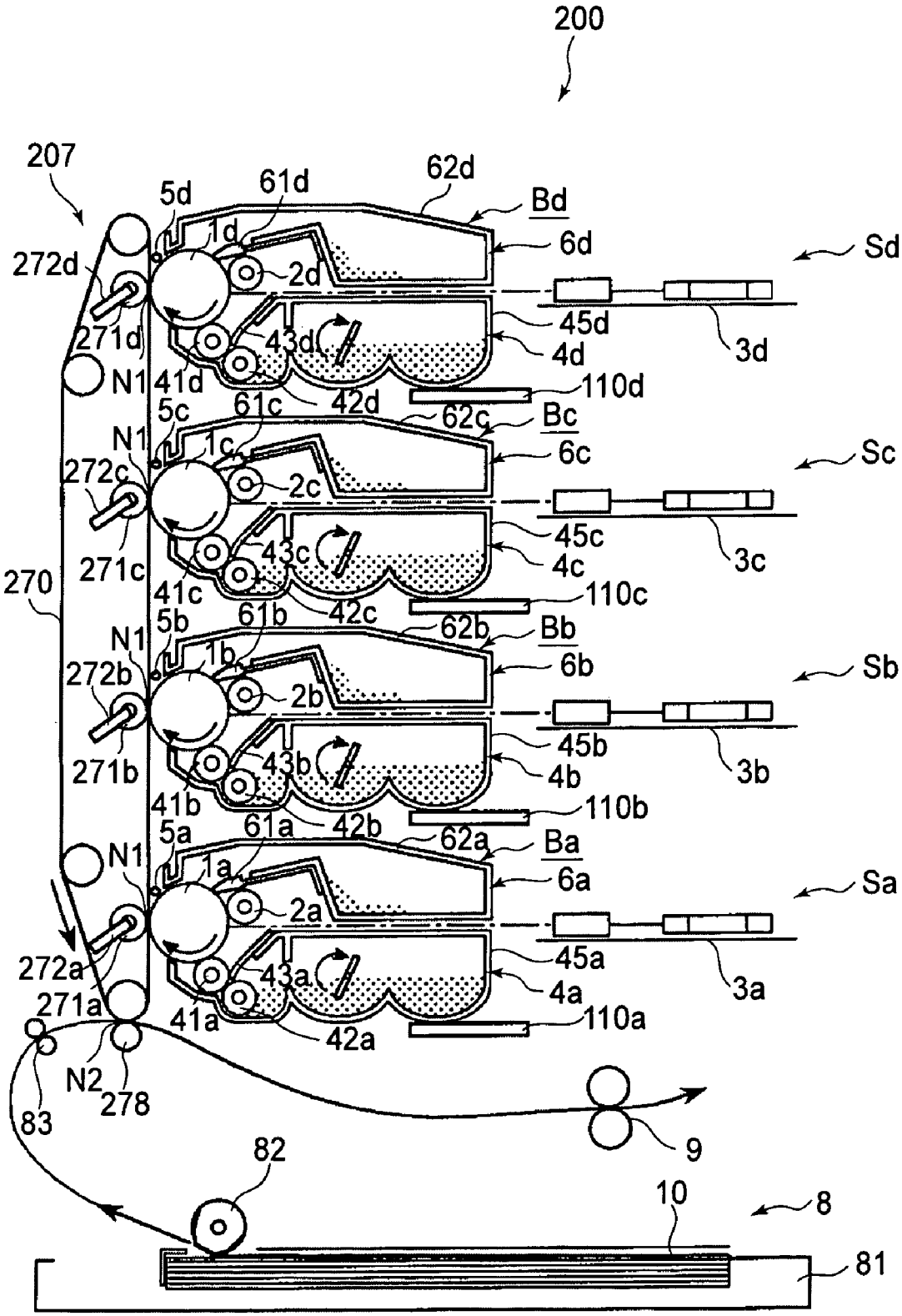
FIG. 11 is a schematic sectional view of another image forming apparatus to which the present invention is applicable.

In the above discussion, the present invention was described with reference to the preferred embodiments of the present invention. However, the preceding preferred embodiments of the present invention are not intended to limit in scope the present invention. For example, the present invention can be applied to image forming apparatuses of the intermediary transfer type, just as effectively as it was applicable to the image forming apparatuses in these embodiments. FIG. 11 is a schematic sectional view of an example of an image forming apparatus of the intermediary transfer type. The image forming apparatus 200 in FIG. 11 has an intermediary transfer unit 207 instead of the transfer unit which the image forming apparatus 100 in FIG. 1 has. The components of the image forming apparatus 200 in FIG. 11, the function and structure of which are the same as, or equivalent to, those of the image forming apparatus 100 in FIG. 11, are given the same referential symbols as those given in FIG. 1, and will not be described in detail.

The intermediary transfer unit 207 has an intermediary transfer member in the form of an endless belt, that is, an intermediary transfer belt 270. Further, the intermediary transfer unit 207 has primary transfer rollers 271, as primary transferring apparatuses, which are disposed so that they oppose the photosensitive drums 1*a*-1*d* of the image formation stations Sa-Sd, respectively. The primary transfer roller 271 presses the intermediary transfer belt 270 against the photosensitive drum 1, forming thereby a primary transfer nip, that is, a primary transfer point N1. Further, the image forming apparatus 200 is structured so that the primary transfer roller 271 in each of the image formation stations Sa-Sd can be moved by a belt separation mechanism 272 to place the intermediary transfer belt 270 in contact with the corresponding photosensitive drum 1 or separate the intermediary transfer belt 270 from the corresponding photosensitive drum 1, independently from the primary transfer rollers 271 in the other image formation stations S. The structures and operations of the components, such as the intermediary transfer belt 270, primary transfer roller 271, and belt separation mechanism 272, of the image forming apparatus 200 are practically the same as those of the transfer unit 7 of the image forming apparatus 100 in FIG. 1. The intermediary transfer unit 207 has a secondary transfer roller 278 as a secondary transferring apparatus. The secondary transfer roller 278 contacts the intermediary transfer belt 270, forming thereby a secondary transfer nip, that is, a secondary transfer point N2. The toner images formed in the image formation stations Sa-Sd, one for one, structured as described above are temporarily transferred (primary transfer) onto the intermediary transfer belt 270 at the primary transfer point N1. Then, the toner images are transferred (secondary transfer) onto the transfer medium 10 at the secondary transfer point N2. Using the above-described process, a full-color or monochromatic image can be formed on the transfer medium 10. Thus, when the image forming apparatus 200 is operated in the monochromatic mode immediately after being operated in the full-color image, the electric discharge which occurs when the intermediary transfer belt 270, as a transferring apparatus, separates from the photosensitive drum 1, can be prevented from affecting the subsequent image formation operations, just as effectively as in the above-described preceding embodiments.

Further, in the above discussion, the image forming apparatuses have been described as such image forming apparatuses that have multiple image formation stations, in each of which the transferring apparatus is placed in contact with, or is separated from, the photosensitive drum 1. However, the application of the present invention is not limited to those described above. Only requirement for the present invention to be applicable to a given image forming apparatus having multiple image formation stations is that an image bearing member and a transferring apparatus can be placed in contact with, or are separable from, each other in at least one of the image formation stations. The present invention is also applicable to an image forming apparatus having only one image formation station, provided that the image bearing member and transferring apparatus of this image formation station can be placed in contact with, or are separable from, each other. The application of the present invention to such an image forming apparatus yields the same effects as those described above. Further, the present invention is applicable to an image forming apparatus having only one image formation station, provided that the transferring apparatus of this image formation station, which is equivalent to the transfer roller in each of the preceding embodiments, can be placed directly in contact with, or separated from, the image bearing member of this image formation station. The application of the present invention to such an image forming apparatus yields the same effects as those described above.

The meaning of "discharge" is not limited to "reduce the potential of an object to 0 V". For example, in the cases of the above-described preferred embodiments, the pre-exposing apparatus 5, as a discharging apparatus, discharged the area (separation discharge area) of the peripheral surface of the photosensitive drum 1, which was where electric discharge had possibly occurred between the conveyor belt 70 and photosensitive drum 1 at least at the moment the conveyor belt 70 was separated from the photosensitive drum 1. All that is required of the pre-exposing apparatus 5 is to discharge the photosensitive drum 1 to such a degree that even if the photosensitive drum 1 is left as it is after the discharge, the memory effected on the peripheral surface of the photosensitive drum 1, that is, the pattern of the nonuniformity of the potential of the peripheral surface of the photosensitive drum 1, does not cause the image forming apparatus to form intolerably flawed image. It is preferable that the above-mentioned area of the peripheral surface of the photosensitive drum 1 is discharged by the pre-exposing apparatus 5 to such a degree that the level of the resultant potential of this area will become the same as the final level to which the potential of the charged image bearing member reduces as the light projected on the charged image bearing member is gradually increased in intensity, that is, the level from which the potential of the above-mentioned area of the peripheral surface of the photosensitive drum 1 does not change even if the light is further increased in intensity.

Further, in the above discussion, the discharging apparatus was described as a pre-exposing apparatus. A pre-exposing apparatus is an apparatus capable of discharging an image bearing member with the light projected from its light source such as an LED, which is relatively small in size and relatively light in weight. Further, it is relatively easy to turn on or off. Therefore, a pre-exposing apparatus can be used as a preferable discharging means. However, the application of the present invention is not limited to image forming apparatuses employing a pre-exposing apparatus as a discharging means. For example, a discharging apparatus, such as a corona discharging device may be employed instead of a pre-exposing apparatus. Further, an image bearing member can be discharged by applying AC voltage, combination of AC and DC voltages, or a voltage, the polarity of which is opposite to the polarity to which the image bearing member is normally charged, to a discharging member, such as an electrically-conductive roller, brush, and blade, placed in contact with the image bearing member. Further, the image bearing member can be discharged by grounding the above-mentioned discharging member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications No. 250254/2005 filed Aug. 30, 2005 and No. 220718/2006 filed Aug. 11, 2006 which are hereby incorporated by reference.

What is claimed is:

1. An image forming apparatus comprising:

a movable image bearing member;

a charging device for electrically charging said image bearing member at a charging position;

a transferring device for contacting said image bearing member at the transfer position and for transferring a toner image from said image bearing member onto a transfer material;

a transferring device contacting and separating mechanism for effecting a separating operation by which said transferring device and said image bearing member contacted to each other are separated from each other;

a discharging device for electrostatically discharging said image bearing member at a discharging position which is upstream of the charging position and which is downstream of the transfer position with respect to a peripheral moving direction of said image bearing member; and a controller for controlling said discharging device to electrically discharge a first region which is a region of said image bearing member which is about to be subjected to electrostatic image formation, and a second region which is a region of said image bearing member which has been charged by said charging device and which has been separated from said transfer device by said transferring device separating and contacting mechanism before said image bearing member is stopped, wherein said controller is capable of stopping said discharging device so as not to electrically discharge a third region which is a region between said first region and said second region.

2. An image forming apparatus comprising:

a movable image bearing member;

a charging device for electrically charging said image bearing member at a charging position;

a transferring device for contacting said image bearing member at the transfer position and for transferring a toner image from said image bearing member onto a transfer material;

a transferring device contacting and separating mechanism for effecting a separating operation by which said transferring device and said image bearing member contacted to each other are separated from each other;

a discharging device for electrostatically discharging said image bearing member at a discharging position which is upstream of the charging position and which is downstream of the transfer position with respect to a peripheral moving direction of said image bearing member; and a controller for controlling said discharging device to electrically discharge a first region which is a region of said image bearing member which is about to be subjected to electrostatic image formation, and a second region which is a region of said image bearing member which has been charged by said charging device and which has been separated from said transfer device by said transferring device separating and contacting mechanism before said image bearing member is stopped, wherein the image forming apparatus is operable in a first mode in which said image bearing member is stopped in a state that said image bearing member and said transferring device are contacted to each other, and in a second mode in which said image bearing member is stopped after said image bearing member and said transferring device which are contacted to each other are separated from each other, wherein in the first mode, the second region is not provided, and in the second mode, the second region is provided, and herein said controller is capable of controlling said discharging device such that a time period from passage of the first region which is about to be subjected to electrostatic image formation immediately before a stop of said image bearing member through the discharging position to a time period when a discharging operation of said discharging device before a stop of said image bearing member, is shorter in the first mode than in the second mode.

3. An apparatus according to claim 2, wherein said image bearing member, said charging device and said discharging device constitute an image forming station and are provided in a plurality of such image forming stations, wherein said transferring device provided for each of said image forming stations is contactable to said image bearing member, and wherein said transferring device contacting and separating mechanism effects the separating operation between said transferring device and at least one of said image bearing members of said image forming stations.

4. An apparatus according to claim 2, further comprising a plurality of image forming stations each including said image bearing member, said charging device and said discharging device, wherein the image forming apparatus is operable in a first image formation mode and a second image formation mode, wherein numbers of said image forming stations which form the images in the first image formation mode and the second image formation mode, are different from each other, wherein said image forming stations include a first image forming section and a second image forming section, wherein in the first image formation mode, said first image forming section and said second image forming section form the images in a contact state, wherein in the second image formation mode, said image bearing member of said first image forming section is separated from said transferring device, and said first image forming section does not form an image, and said image bearing member of said second image forming station section forms the an image in the contact state, and wherein when an image formation is carried out in the second image formation mode after an image formation in the first image formation mode, said image bearing member of said first image forming section is stopped in said second mode.

5. An apparatus according to claim 4, wherein when said image bearing members are stopped after the image formation in the first image formation mode, said image bearing members of said first and second image forming sections are stopped in the first mode.

6. An apparatus according to claim 4, wherein when said image bearing member of said second image forming section is stopped after the image formation in the second image formation mode, said image bearing member of said second image forming section is stopped in the first mode.

7. An apparatus according to claim 4, wherein in said second image formation mode, the image is formed using only black toner.

* * * * *